US012024398B2

(12) United States Patent
Itotani

(10) Patent No.: US 12,024,398 B2
(45) Date of Patent: Jul. 2, 2024

(54) SHEET TRANSPORT APPARATUS AND SHEET PROCESSING APPARATUS

(71) Applicant: Glory Ltd., Himeji (JP)

(72) Inventor: Kojiro Itotani, Hyogo (JP)

(73) Assignee: GLORY LTD., Himeji (JP)

( * ) Notice: Subject to any disclaimer, the term of this patent is extended or adjusted under 35 U.S.C. 154(b) by 0 days.

(21) Appl. No.: 18/121,048

(22) Filed: Mar. 14, 2023

(65) Prior Publication Data

US 2023/0211969 A1 Jul. 6, 2023

Related U.S. Application Data

(63) Continuation of application No. 17/207,767, filed on Mar. 22, 2021, now Pat. No. 11,629,021.

(30) Foreign Application Priority Data

Mar. 23, 2020 (JP) ..... 2020-050788

(51) Int. Cl.
*B65H 9/00* (2006.01)
*B65H 5/06* (2006.01)
*B65H 7/06* (2006.01)

(52) U.S. Cl.
CPC ..... *B65H 9/002* (2013.01); *B65H 5/062* (2013.01); *B65H 7/06* (2013.01);
(Continued)

(58) Field of Classification Search
CPC ..... B65H 9/002; B65H 2511/216; B56H 2301/33216; B56H 2301/33222
See application file for complete search history.

(56) References Cited

U.S. PATENT DOCUMENTS 4,155,440 A * 5/1979 Bogdanski ..... B65H 5/062 271/274
5,755,437 A 5/1998 Ek
(Continued)

FOREIGN PATENT DOCUMENTS

EP 2261166 A1 12/2010
JP 8-290853 A 11/1996
(Continued)

OTHER PUBLICATIONS

Extended European search report dated Jul. 27, 2021, in corresponding European patent Application No. 21163076.9, 8 pages.

*Primary Examiner* — Patrick Cicchino
(74) *Attorney, Agent, or Firm* — XSENSUS LLP

(57) ABSTRACT

A sheet transport apparatus includes a first direction changing roller arranged along a transport path, wherein a sheet is transported along the transport path; a second direction changing roller disposed on the transport path, wherein the first direction changing roller and the second direction changing roller are next to each other in a direction perpendicular to the transport path, and the first direction changing roller and the second direction changing roller change an orientation of the sheet from a first orientation to a second orientation; and a control circuit configured to control one of the first direction changing roller and the second direction changing roller so that the first direction changing roller rotates slower than the second direction changing roller so as to change the orientation of the sheet from the first orientation to the second orientation.

16 Claims, 14 Drawing Sheets

(52) U.S. Cl.
CPC ..... *B65H 2301/33216* (2013.01); *B65H 2301/33222* (2013.01); *B65H 2404/1441* (2013.01); *B65H 2511/216* (2013.01); *B65H 2513/11* (2013.01); *B65H 2701/1912* (2013.01)

(56) References Cited

U.S. PATENT DOCUMENTS

| | | | | | |
|---|---|---|---|---|---|
| 5,836,439 | A * | 11/1998 | Coyette | B65H 5/18 198/411 |
| 5,931,462 | A | 8/1999 | Delfosse | |
| 6,601,844 | B2 * | 8/2003 | Ballestrazzi | B65H 5/023 271/100 |
| 6,896,256 | B2 * | 5/2005 | Hozumi | B65H 5/062 271/227 |
| 8,459,640 | B2 * | 6/2013 | Ui | B65H 9/006 271/228 |
| 8,573,383 | B2 * | 11/2013 | Koo | B65H 29/70 198/397.06 |
| 2010/0314217 | A1 | 12/2010 | Asari et al. | |
| 2019/0308836 | A1 * | 10/2019 | McCarthy | B65H 9/002 |
| 2019/0315586 | A1 | 10/2019 | Yamane et al. | |
| 2020/0028876 | A1 | 1/2020 | Cohen et al. | |
| 2020/0231150 | A1 | 7/2020 | Takahashi | |
| 2020/0320114 | A1 | 10/2020 | Sparrow | |

FOREIGN PATENT DOCUMENTS

| | | | |
|---|---|---|---|
| JP | 10-45280 | A | 2/1998 |
| JP | 2002-347989 | A | 12/2002 |
| JP | 2009-173420 | A | 8/2009 |
| JP | 2010-285224 | A | 12/2010 |
| JP | 2010-285244 | A | 12/2010 |

* cited by examiner

SHEET TRANSPORT APPARATUS AND SHEET PROCESSING APPARATUS

CROSS-REFERENCE TO RELATED APPLICATIONS

This application is a continuation of U.S. application Ser. No. 17/207,767, filed Mar. 22, 2021, which claims priority to Japanese Patent Application No. 2020-050788 filed on Mar. 23, 2020, the entire disclosure of each are incorporated herein by reference.

TECHNICAL FIELD

The present disclosure relates to a sheet transport apparatus and a sheet processing apparatus.

BACKGROUND

Conventionally, in a banknote processing apparatus, a technique of changing the orientation of a banknote being transported while having an orientation in which the long side of the banknote faces forward in the transport direction to an orientation in which the short side of the banknote faces forward in the transport direction is known.

In such a conventional technique, a pair of upstream correction rollers on the upstream side in the transport direction and a pair of downstream correction rollers on the downstream side are used to change, to the orientation in which the short side faces forward in the transport direction, the orientation in which the long side faces forward in the transport direction by controlling each of the correction rollers such that the sum of the rotation angle of the banknote rotated by the pair of upstream correction rollers and the rotation angle of the banknote rotated by the pair of downstream correction rollers is 90°.

SUMMARY

An aspect of the present disclosure relates to a sheet transport apparatus comprising a first direction changing roller arranged along a transport path, wherein a sheet is transported along the transport path; a second direction changing roller disposed on the transport path, wherein the first direction changing roller and the second direction changing roller are next to each other in a direction perpendicular to the transport path, and the first direction changing roller and the second direction changing roller change an orientation of the sheet from a first orientation to a second orientation; and a control circuit configured to control one of the first direction changing roller and the second direction changing roller so that the first direction changing roller rotates slower than the second direction changing roller so as to change the orientation of the sheet from the first orientation to the second orientation.

DETAILED DESCRIPTION OF THE DRAWINGS

In the conventional technique, there is a possibility that the apparatus may become large in size because the orientation of the banknote is changed by two times of rotation processes using the upstream correction rollers and the downstream correction rollers. There is also a possibility that a control for transferring a banknote between the upstream correction rollers and the downstream correction rollers becomes complicated.

The present disclosure aims to provide a sheet transport apparatus and a sheet processing apparatus capable of changing the orientation of a sheet with easy control while preventing the enlargement of the apparatuses.

According to the sheet transport apparatus and the sheet processing apparatus of the present disclosure, it is possible to change the orientation of a sheet with an easy control while preventing the enlargement of the apparatuses.

Hereinafter, an embodiment of the present disclosure will be described with reference to the drawings.

<Overall Configuration of Sheet Processing Apparatus>

Figure 1:
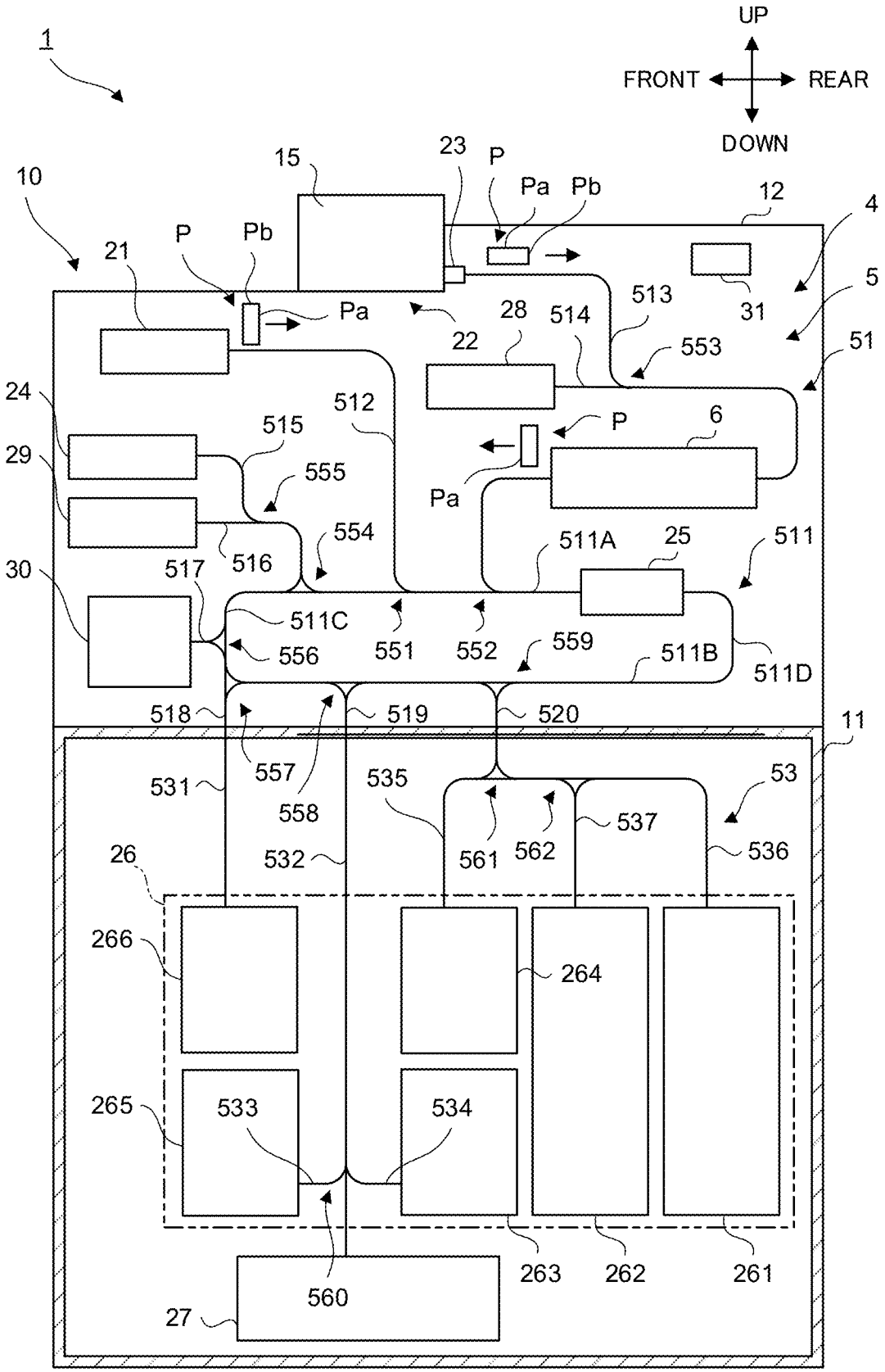
FIG. 1 is a block diagram illustrating an overall configuration of a sheet processing apparatus.

To begin with, the overall configuration of a sheet processing apparatus will be described. FIG. 1 is a block diagram illustrating the overall configuration of the sheet processing apparatus according to an embodiment of the present disclosure. The arrangement of components of the sheet processing apparatus may be described using the directions illustrated in FIG. 1. Note that, a banknote is transported in both the front and rear directions illustrated in FIG. 1. Accordingly, the transport direction of the banknote considering a case where the banknote is deposited is referred to as "deposit transport direction," the transport direction of the banknote considering a case where the banknote is withdrawn is referred to as "withdrawal transport direction," and the transport direction of the banknote considered without particularly distinguishing between the deposit and the withdrawal of the banknote is referred to as "transport direction."

The sheet processing apparatus 1 illustrated in FIG. 1 processes a banknote that is an example of a sheet. The sheet processing apparatus 1 is installed in a back office of a financial institution such as a bank, for example. Note that, the sheet processing apparatus 1 may be installed in a back office of a store such as a retail store. The sheet processing apparatus 1 comprises a housing 10 including a lower housing 11 and an upper housing 12. The lower housing 11 has a structure as a safe. The lower housing 11 is configured such that only an authorized person such as a manager can open a door. The upper housing 12 is disposed above the lower housing 11.

The sheet processing apparatus 1 further comprises a deposit section 21, a cassette loading section 22, a deposit/withdrawal section 23, a withdrawal section 24, a recognition section 25, a storage section 26, a collection section 27, an upper reject storage section 28, a counting reject storage section 29, a temporary storage section 30, a sheet transport apparatus 4, and a control section 31. The deposit section 21, the cassette loading section 22, the deposit/withdrawal section 23, the withdrawal section 24, the recognition section 25, the upper reject storage section 28, the counting reject storage section 29, the temporary storage section 30, and the control section 31 are disposed in the upper housing 12. The storage section 26 and the collection section 27 are disposed in the lower housing 11. The control section 31 may also be referred to as a processor or an internal computer. Note that, the control section 31 may be disposed in the lower housing 11. A structural configuration of control section 31 is described below with respect to FIG. 12.

The sheet transport apparatus 4 is configured to be capable of transporting a banknote P between the lower housing 11 and the upper housing 12. The sheet transport apparatus 4 is comprised, for example, of an endless belt guided on at least a pair of rollers or at least one roller, and a motor for driving them.

The deposit section 21 is configured such that a plurality of banknotes P manually put in by an operator can be stacked on one another in the deposit section. The deposit section 21 has a feeding mechanism for taking in (receiving) a plurality of stacked banknotes P one by one, with the banknotes having an orientation in which the long side Pa of the banknotes P faces forward in the intake direction. The feeding mechanism is comprised of at least a pair of rollers and the like. Hereinafter, transporting the banknote P while the banknote has the orientation in which the long side Pa faces forward in the transport direction may be referred to as "short-edge transporting."

The cassette loading section 22 is configured such that a banknote transport cassette 15 can be loaded into the cassette loading section 22. When the banknote transport cassette 15 is loaded into the cassette loading section 22, the connector of the cassette loading section 22 is connected to the connector of the banknote transport cassette 15, so that the banknote transport cassette 15 can be controlled by the control section 31.

The banknote transport cassette 15 has at least a feeding mechanism for outletting the banknote P, with the banknote having an orientation in which the short side Pb of the banknote P faces forward in the transport direction, a storage mechanism for storing the banknote P transported while having the orientation in which the short side Pb faces forward in the transport direction, and a motor for driving these mechanisms. Hereinafter, transporting the banknote P while the banknote has the orientation in which the short side Pb faces forward in the transport direction may be referred to as "long-edge transporting." The banknote transport cassette 15 is configured to be capable of giving and receiving banknotes P to and from a specific apparatus such as the sheet processing apparatus 1 when the cassette is loaded into the specific apparatus. The banknote transport cassette 15 is configured such that the banknote P inside the cassette cannot be taken out when the cassette is detached from the specific apparatus. Note that, the banknote transport cassette 15 may comprise respective motors for operating the feeding mechanism and the storage mechanism. Further, a structure may be employed in which a motor for driving the feeding mechanism and the storage mechanism of the banknote transport cassette 15 is disposed inside the sheet processing apparatus 1, and the power for the feeding mechanism and the storing mechanism is supplied from this motor.

The deposit/withdrawal section 23 has an opening (port) for receiving the banknote P that is outlet from the banknote transport cassette 15 loaded into the cassette loading section 22, and that is to be long-edge transported, and for transporting the banknote P to the sheet transport apparatus 4 without changing the orientation of the banknote. The opening of the deposit/withdrawal section 23 is also for transporting, to the banknote transport cassette 15, the banknote P long-edge transported from the sheet transport apparatus 4, while not changing the orientation of the banknote.

The withdrawal section 24 is configured such that the banknotes P transported from the sheet transport apparatus 4 can be stacked in the withdrawal section in such a manner as to allow the operator to take the banknotes out.

As one process, the recognition section 25 generates signals indicating the denominations, authenticity, and fitness of banknotes P transported by the sheet transport apparatus 4. These signals are transmitted to the control section 31. The recognition section 25 can also generate a signal for detecting the orientations and sizes of the banknotes P being transported and the interval between the banknotes P, and transmit the signal to the control section 31.

The storage section 26 comprises a first storage cassette 261, a second storage cassette 262, a third storage cassette 263, a fourth storage cassette 264, a fifth storage cassette 265, and a sixth storage cassette 266. The first storage cassette 261 is disposed on the rear side in the lower housing 11. The second storage cassette 262 is disposed on the front side of the first storage cassette 261. The third storage cassette 263 is disposed on the front side of the second storage cassette 262. The fourth storage cassette 264 is disposed on the upper side of the third storage cassette 263. The fifth storage cassette 265 is disposed on the front side of the third storage cassette 263. The sixth storage cassette 266 is disposed on the front side of the fourth storage cassette 264 and on the upper side of the fifth storage cassette 265. The first to the sixth storage cassettes 261 to 266 are stack-type storage cassettes in which the banknotes P are stored while stacked on one another. Note that, at least one of the first to the sixth storage cassettes 261 to 266 may be a tape-type cassette in which the banknotes P together with a beltlike tape attached to the outer peripheral surface of a drum are wound around the drum. The first to the sixth storage cassettes 261 to 266 take in and store the banknotes P one by one, and feed the stored banknotes one by one. The denomination stored in each of the first to the sixth storage cassettes 261 to 266 is set in advance.

The collection section 27 is configured to be capable of collecting the banknotes P stored in the first to the sixth storage cassettes 261 to 266, for example, at the time of a collection process.

The upper reject storage section 28 is configured to store therein, those banknotes P which are determined as being non-depositable by the control section 31 based on the signal from the recognition section 25, for example, during a deposit process in which the banknotes P outlet from the banknote transport cassette 15 to the sheet transport apparatus 4 are stored in the storage section 26. The upper reject storage section 28 is configured to store therein, those banknotes P which are determined as being non-withdrawable by the control section 31 based on the signal from the recognition section 25, for example, during a withdrawal process in which the banknotes P stored in the storage section 26 are withdrawn. The upper reject storage section 28 is configured such that the stored banknotes P can be taken out from the outside.

The counting reject storage section 29 stores therein those banknotes which are determined by the control section 31 based on the signal from the recognition section 25 as being particularly largely skewed among the banknotes P determined as non-depositable, for example, during the deposit process on the banknotes P outlet from the banknote transport cassette 15 to the sheet transport apparatus 4. The counting reject storage section 29 is configured such that the stored banknotes P can be taken out from the outside.

The temporary storage section 30 temporarily stores therein banknotes P, for example, during the deposit process. The temporary storage section 30 is a tape-type storage section that stores the banknotes P by winding the banknote P together with a tape on the drum.

The control section 31 controls the entire sheet processing apparatus 1. Details of processing of the control section 31 will be described later.

The sheet transport apparatus 4 comprises a transport section 5 and an orientation changing unit 6. Note that, the detailed configuration of the orientation changing unit 6 will be described later.

The transport section 5 comprises an upper transport section 51 and a lower transport section 53. The upper transport section 51 is disposed in the upper housing 12. The lower transport section 53 is disposed in the lower housing 11.

The upper transport section 51 comprises a first transport path 511, a second transport path 512, a third transport path 513, a fourth transport path 514, a fifth transport path 515, a sixth transport path 516, a seventh transport path 517, an eighth transport path 518, a ninth transport path 519, and a tenth transport path 520.

The first transport path 511 is formed in a loop shape. The first transport path 511 comprises an upper path 511A extending forward and rearward, a lower path 511B extending forward and rearward below the upper path 511A, a front inversion path 511C connecting the upper path 511A to the lower path 511B at the front side, and a rear inversion path 511D connecting the upper path 511A to the lower path 511B at the rear side. The recognition section 25 is disposed on the upper path 511A.

The second transport path 512 connects a portion of the upper path 511A at a position on the front side of the recognition section 25 to the deposit section 21. A first diversion mechanism 551 is disposed on the connection portion between the second transport path 512 and the upper path 511A.

The third transport path 513 connects a portion of the upper path 511A at a position between the first diversion mechanism 551 and the recognition section 25 to the deposit/withdrawal section 23. A second diversion mechanism 552 is disposed on the connection portion between the third transport path 513 and the upper path 511A. The orientation changing unit 6 is disposed on the third transport path 513.

The fourth transport path 514 connects the upper reject storage section 28 to the third transport path 513. A third diversion mechanism 553 is disposed on the connection portion between the fourth transport path 514 and the third transport path 513.

The fifth transport path 515 connects a portion of the upper path 511A at a position on the front side of the first diversion mechanism 551 to the withdrawal section 24. A fourth diversion mechanism 554 is disposed on the connection portion between the fifth transport path 515 and the upper path 511A.

The sixth transport path 516 connects the fifth transport path 515 to the counting reject storage section 29. A fifth diversion mechanism 555 is disposed on the connection portion between the sixth transport path 516 and the fifth transport path 515.

The seventh transport path 517 connects the front inversion path 511C to the temporary storage section 30. A sixth diversion mechanism 556 is disposed on the connection portion between the seventh transport path 517 and the front inversion path 511C.

The eighth transport path 518 connects the front inversion path 511C to the lower transport section 53. The eighth transport path 518 and the lower transport section 53 are connected to each other via a transport path penetrating the lower housing 11. A seventh diversion mechanism 557 is disposed on the connection portion between the eighth transport path 518 and the front inversion path 511C.

The ninth transport path 519 connects the lower path 511B to the lower transport section 53. The ninth transport path 519 and the lower transport section 53 are connected to each other via a transport path penetrating the lower housing 11. An eighth diversion mechanism 558 is disposed on the connection portion between the ninth transport path 519 and the lower path 511B.

The tenth transport path 520 connects a portion of the lower path 511B at a position on the rear side of the eighth diversion mechanism 558 to the lower transport section 53. The tenth transport path 520 and the lower transport section 53 are connected to each other via a transport path penetrating the lower housing 11. The ninth diversion mechanism 559 is disposed on the connection portion between the tenth transport path 520 and the lower path 511B.

The lower transport section 53 comprises an eleventh transport path 531, a twelfth transport path 532, a thirteenth transport path 533, a fourteenth transport path 534, a fifteenth transport path 535, and a sixteenth transport path 536.

The eleventh transport path 531 connects the eighth transport path 518 to the sixth storage cassette 266.

The twelfth transport path 532 connects the ninth transport path 519 to the collection section 27.

The thirteenth transport path 533 connects the twelfth transport path 532 to the fifth storage cassette 265.

The fourteenth transport path 534 connects the twelfth transport path 532 to the third storage cassette 263. A tenth diversion mechanism 560 is disposed on the connection portion between the fourteenth transport path 534, the thirteenth transport path 533, and the twelfth transport path 532.

The fifteenth transport path 535 connects the tenth transport path 520 to the fourth storage cassette 264.

The sixteenth transport path 536 connects the fifteenth transport path 535 to the first storage cassette 261. An eleventh diversion mechanism 561 is disposed on the connection portion between the sixteenth transport path 536 and the fifteenth transport path 535.

The seventeenth transport path 537 connects the sixteenth transport path 536 to the second storage cassette 262. A twelfth diversion mechanism 562 is disposed on the connection portion between the seventeenth transport path 537 and the sixteenth transport path 536.

The first to the seventeenth transport paths 511 to 520 and 531 to 537 are comprised of a combination of a roller, a belt wound around the roller, a motor for driving the roller, a side wall, and the like. Tracking sensors for detecting the passage of a banknote P are disposed at predetermined positions on the first to the seventeenth transport paths 511 to 520 and 531 to 537. The control section 31 detects the position of the banknote P based on a detection signal from the tracking sensor and transports the banknote P to a predetermined component by controlling the first to the twelfth diversion mechanisms 551 to 562.

<Detailed Configuration of Orientation Changing Unit>

Figure 2A:
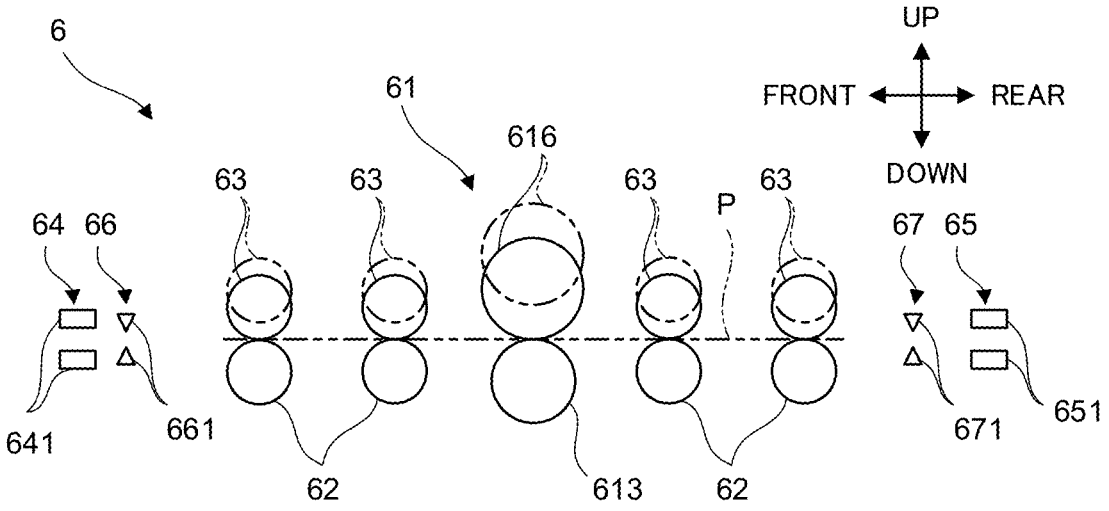
FIG. 2A schematically illustrates an outline configuration of an orientation changing unit as viewed from a right side.
Figure 2B:
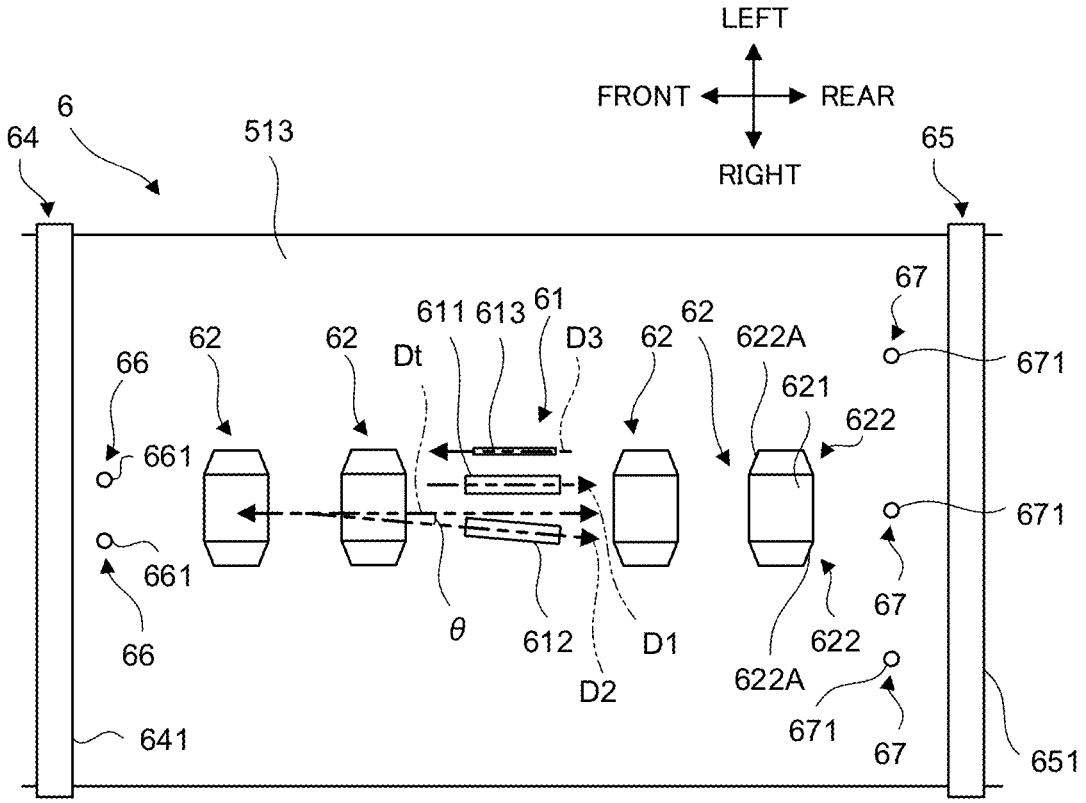
FIG. 2B schematically illustrates an outline configuration of the orientation changing unit as viewed from an upper side.
Figure 3A:
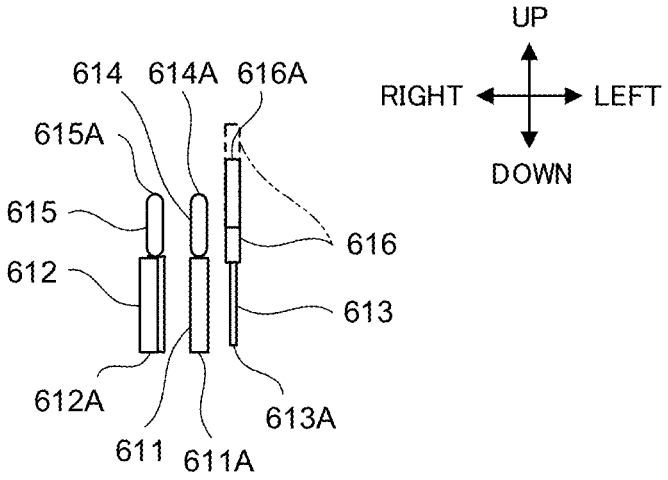
FIG. 3A schematically illustrates an outline configuration of an orientation changing section as viewed from a rear side.
Figure 3B:
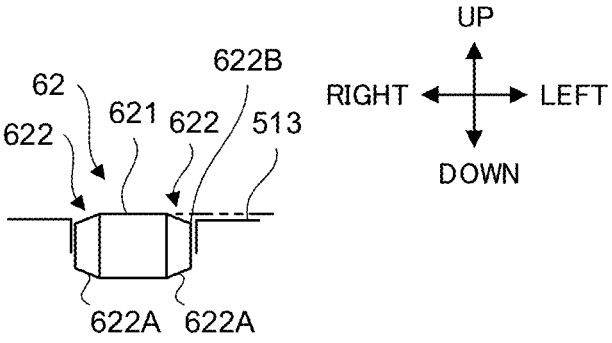
FIG. 3B schematically illustrates an outline configuration of a lower roller as viewed from the rear side.
Figure 4:
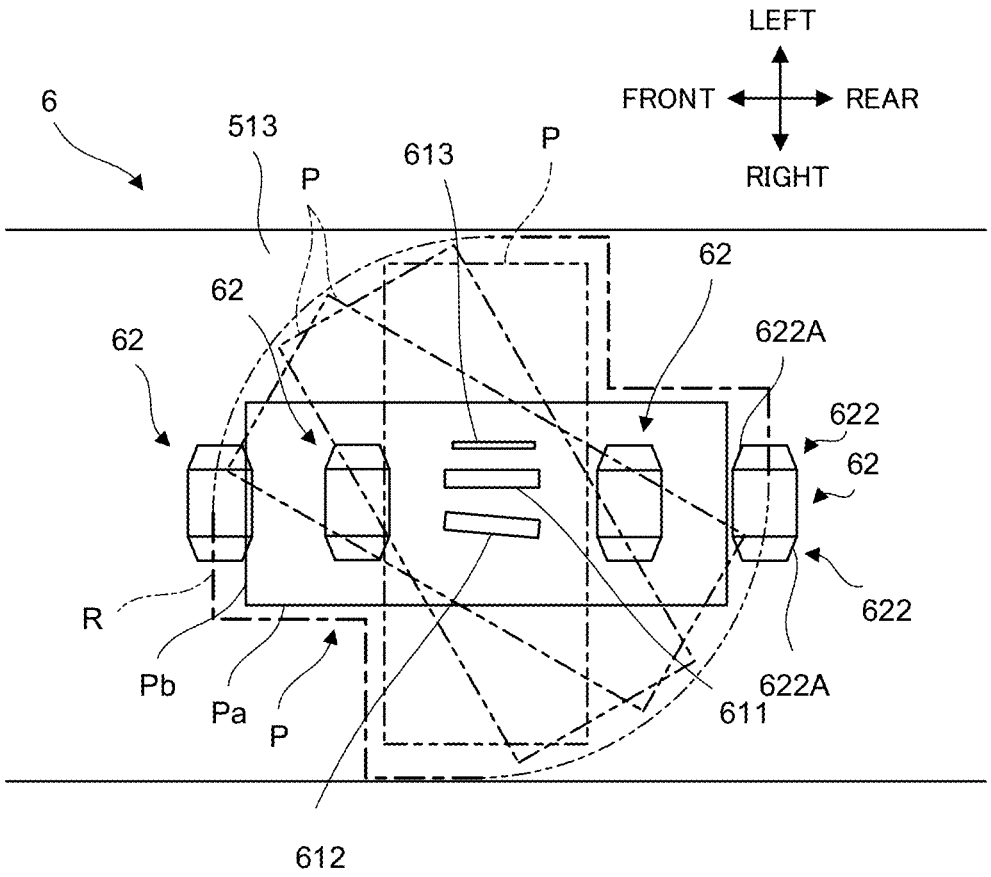
FIG. 4 schematically illustrates the relationship between a rotation track of a banknote and the arrangement positions of lower rollers.

Next, a detailed configuration of the orientation changing unit 6 will be described. FIG. 2A schematically illustrates an outline configuration of the orientation changing unit as seen from the right side. FIG. 2B schematically illustrates an outline configuration of the orientation changing unit as seen from the upper side. FIG. 3A schematically illustrates an outline configuration of an orientation changing section as seen from the rear side. FIG. 3B schematically illustrates an outline configuration of a lower roller as seen from the rear side. FIG. 4 schematically illustrates the relationship between the rotation track of a banknote and the arrangement position of lower rollers.

As illustrated in FIGS. 2A and 2B, the orientation changing unit 6 comprises an orientation changing section 61, four lower rollers 62, four upper rollers 63, a front detection section 64, a rear detection section 65, two sets of front tracking sensors 66, and three sets of rear tracking sensors 67.

The orientation changing section 61 changes the orientation of a banknote P being transported from the deposit/withdrawal section 23 to the recognition section 25 from the long-edge transport orientation to the short-edge transport orientation. The orientation changing unit 6 changes the orientation of a banknote P being transported from the recognition section 25 to the deposit/withdrawal section 23 from the short-edge transport orientation to the long-edge transport orientation. The orientation changing section 61 comprises a first direction changing roller 611, a second direction changing roller 612, a third direction changing roller 613, a first contact roller 614, a second contact roller 615, a third contact roller 616, and a motor for driving each of the first direction changing roller 611, the second direction changing roller 612, and the third direction changing roller 613 as illustrated in FIGS. 2A, 2B, and 3A. The motor is a stepper motor, and is controlled to be driven by the control section 31. A DC motor may be used instead of the stepper motor.

The first and the second direction changing rollers 611 and 612 are formed in the same shape. The third direction changing roller 613 is formed in a shape smaller and thinner than the first direction changing roller 611. Each of the outer peripheral surfaces 611A, 612A, and 613A of the first, the second, and the third direction changing rollers 611, 612, and 613 is formed in a flat surface shape in a section along the axis of rotation of the roller.

The first, the second, and the third direction changing rollers 611, 612, and 613 are disposed side by side in the width direction (left-right direction) of the third transport path 513 (hereinafter, the "width direction of the third transport path 513" may be referred to as the "width direction of the transport path"). The first direction changing roller 611 is disposed between the second direction changing roller 612 and the third direction changing roller 613. The second direction changing roller 612 is disposed on the right side of the first direction changing roller 611. The first and the third direction changing rollers 611 and 613 are disposed to transport the banknote Pin a direction along the third transport path 513 (hereinafter, the "direction along the third transport path 513" may be referred to as a "direction of the transport path"). The second direction changing roller 612 is disposed to transport the banknote P in a direction diverging away from the first direction changing roller 611 downstream (toward the rear side) along the third transport path 513 in a case where the banknote P is transported rearward. That is, as indicated by the two-dot chain lines in FIG. 2B, when the direction of the transport path is denoted by Dt, and the withdrawal transport directions of the banknotes P transported by the first, the second, and the third direction changing rollers 611, 612, and 613 in a case where the banknotes P are to be transported rearward during withdrawal are denoted by D1, D2, and D3, respectively, the withdrawal transport direction D1 and the withdrawal transport direction D3 are paralleled to the direction Dt of the transport path. The withdrawal transport direction D3 is opposite to the withdrawal transport direction D1. The withdrawal transport direction D2 is a direction inclined by an angle θ with respect to the direction Dt of the transport path.

The first and the second contact rollers 614 and 615 are formed in the same shape. The third contact roller 616 is formed in a shape larger than the first and the second contact rollers 614 and 615. The outer peripheral surfaces 614A and 615A of the first and the second contact rollers 614 and 615 in the sections along the respective axes of rotation are formed in a curved surface shape. The outer peripheral surface 616A of the third contact roller 616 in the section along the axis of rotation is formed in a flat surface shape.

The first, the second, and the third contact rollers 614, 615, and 616 are disposed above the first, the second, and the third direction changing rollers 611, 612, and 613, respectively. The first, the second, and the third contact rollers 614, 615, and 616 are disposed to transport the banknote P in the same direction as the first, the second, and the third direction changing rollers 611, 612, and 613, respectively. The first, the second, and the third contact rollers 614, 615, and 616 are disposed to make contact with the banknote P together with the first, the second, and the third direction changing rollers 611, 612, and 613. The third contact roller 616 is configured such that a driving section such as a solenoid comprised by a raising and lowering mechanism is controlled by the control section 31, so that the it is possible to switch third contact roller 616 between a lowered position where the third contact roller 616 together with the third direction changing roller 613 makes contact with the banknote P as illustrated in FIGS. 2A and 3A by the solid line and a raised position where the third contact roller 616 does not make contact with the banknote P as illustrated by the two-dot chain line.

Each of the lower rollers 62 comprises a cylindrical straight barrel portion 621, and frustoconical portions 622 disposed at both axial ends of the straight barrel portion 621. Each of the frustoconical portions 622 is formed such that its diameter decreases with increasing distance from the straight barrel portion 621. The inclined surface 622A of the frustoconical portion 622 is an example of an inclined portion inclined to come closer to the axis of the lower roller 62 toward the outside of the lower roller 62 in the axial direction. The four lower rollers 62 are disposed side by side in the front-rear direction as illustrated in FIGS. 2A and 2B, so as to transport the banknote P in the direction Dt of the transport path. Two of the lower rollers 62 are disposed on the front side of the orientation changing section 61. The remaining two lower rollers 62 are disposed on the rear side of the orientation changing section 61. Each of the lower rollers 62 is disposed such that the outer peripheral surface of the straight barrel portion 621 is positioned above the upper surface of the third transport path 513, and the upper end 622B of the end face of the lower roller 62 is positioned below the upper surface of the third transport path 513 as illustrated in FIG. 3B. As illustrated in FIG. 4, the four lower rollers 62 are disposed such that at least a part of the rollers is positioned within the rotation track R of the banknote P.

The upper rollers 63 are formed in a cylindrical shape. Four upper rollers 63 are disposed above the four lower rollers 62, respectively. The upper rollers 63 are disposed to transport the banknote P in the same direction as the lower rollers 62. The upper rollers 63 are configured such that a driving section such as a solenoid comprised by a raising and lowering mechanism is controlled by the control section 31, so that it is possible to switch the upper rollers 63 between a lowered position where the upper rollers 63 together with the lower rollers 62 make contact with the banknote P as illustrated in FIG. 2A by the solid line and a raised position where the upper rollers 63 do not make contact with the banknote P as illustrated by the two-dot chain line.

The front detection section 64 is disposed in front of the frontmost lower roller 62. The front detection section 64 is comprised of a pair of upper and lower line sensors 641. The front detection section 64 detects the orientation of the banknote P transported between the pair of line sensors 641, the length of the banknote P in the direction Dt of the transport path, the position of the banknote P in the width direction of the transport path, and the like.

The rear detection section 65 is disposed in rear of the rearmost lower roller 62. Like the front detection section 64, the rear detection section 65 is comprised of a pair of upper and lower line sensors 651, and detects the orientation of the banknote P transported between the pair of line sensors 651, the length of the banknote Pin the direction Dt of the transport path, the position of the banknote P in the width direction of the transport path, and the like.

Two sets of front tracking sensors 66 are disposed side by side in the width direction of the transport path between the front detection section 64 and the frontmost lower roller 62. Each of the two sets of front tracking sensor 66 is comprised of a pair of upper and lower sensors 661, and detects the passage of the banknote P transported between the pair of upper and lower sensors 661.

Three sets of rear tracking sensors 67 are disposed side by side in the width direction of the transport path between the rear detection section 65 and the rearmost lower roller 62. Each of the three sets of rear tracking sensors 67 is comprised of a pair of upper and lower sensors 671, and detects the passage of the banknote P transported between the pair of upper and lower sensors 671.

<Operation of Sheet Processing Apparatus>

Next, the operation of the sheet processing apparatus 1 will be described. Note that, the operation described below is merely an example, and other processing can be performed as long as the other processing is applicable to the sheet processing apparatus 1.

(Deposit Process from Deposit Section)

To begin with, a description will be given of the deposit process from the deposit section 21 as an operation of the sheet processing apparatus 1. In the deposit process from the deposit section 21, the control section 31 of the sheet processing apparatus 1 stores, in the first to the sixth storage cassettes 261 to 266, the banknote P taken in from the deposit section 21 while having the short-edge transport orientation, without the banknote P being rotated, and, with the banknote P having the short-edge transport orientation.

The operator puts at least one banknote P into the deposit section 21 while the banknote P has the short-edge transport orientation, and performs an operation of starting the deposit process using an operation section of the sheet processing apparatus 1. The control section 31 controls the deposit section 21, the transport section 5, and the first and the second diversion mechanisms 551 and 552, to transport one banknote P after another to the recognition section 25. The recognition section 25 recognizes the denomination, authenticity, and fitness of the banknote P sequentially transported, generates a signal indicating the recognition result, and outputs the signal to the control section 31. Based on the received signal, the control section 31 determines whether the banknote P is a depositable banknote P or a non-depositable banknote P.

The control section 31 controls the transport section 5, the seventh to the twelfth diversion mechanisms 557 to 562, and the first to the sixth storage cassettes 261 to 266 based on the recognition result, and stores depositable banknotes P in the first to the sixth storage cassettes 261 to 266 according to denominations. At this time, the banknotes P are stored in the first to the sixth storage cassettes 261 to 266 while having the short-edge transport orientation.

The control section 31 controls the transport section 5 and the fourth to the ninth diversion mechanisms 554 to 559 based on the recognition result to transport non-depositable banknotes P to the withdrawal section 24, with the banknotes having the short-edge transport orientation.

Note that, the control section 31 may temporarily store the depositable banknotes P in the temporary storage section 30, and control the temporary storage section 30 such that the banknotes P in the temporary storage section 30 are stored in the first to the sixth storage cassettes 261 to 266 after the processing on all the banknotes P put in the deposit section 21 ends. For example, the control section 31 controls the transport section 5, the sixth to ninth diversion mechanisms 556 to 559, and the temporary storage section 30 to temporarily store the depositable banknotes P in the temporary storage section 30. The control section 31 controls the transport section 5 and the fourth to the ninth diversion mechanisms 554 to 559 to transport the non-depositable banknotes P to the withdrawal section 24. The control section 31 may control the temporary storage section 30, the transport section 5, the recognition section 25, the fourth and the sixth to the twelfth diversion mechanisms 554 and 556 to 562, and the first to the sixth storage cassettes 261 to 266 such that the depositable banknotes P temporarily stored in the temporary storage section 30 are stored in the first to the sixth storage cassettes 261 to 266 by denominations after the processing on all the banknotes P put in the deposit section 21 ends.

(Withdrawal Process to Withdrawal Section)

Next, the withdrawal process to the withdrawal section 24 will be described. In the withdrawal process to the withdrawal section 24, the sheet processing apparatus 1 dispenses, from the withdrawal section 24, those banknotes P which are fed from the first to the sixth storage cassettes 261 to 266 while having the short-edge transport orientation, with the banknotes P having the short-edge transport orientation.

The operator performs an operation of starting the withdrawal process on a predetermined number of banknotes P of predetermined denominations. The control section 31 controls the first to the sixth storage cassettes 261 to 266, the transport section 5, and the seventh to the twelfth diversion mechanisms 557 to 562 to transport the banknotes P one by one to the recognition section 25. At this time, the banknotes P are transported to the recognition section 25 while having the short-edge transport orientation. The recognition section 25 recognizes the banknotes P sequentially transported, generates a signal indicating the recognition result, and outputs the signal to the control section 31. Based on the received signal, the control section 31 determines whether each of the banknotes P is a withdrawable banknote P or a non-withdrawable banknote P.

Based on the recognition result, the control section 31 controls the transport section 5 and the first, the second, the fourth, and the fifth diversion mechanisms 551, 552, 554, and 555 to transport the withdrawable banknotes P to the withdrawal section 24, with the banknotes having the short-edge transport orientation.

The control section 31 controls the transport section 5, the first, the second, the fourth, and the sixth diversion mechanisms 551, 552, 554, and 556, and the temporary storage section 30 based on the recognition result, to temporarily store the non-withdrawable banknotes P in the temporary storage section 30, with the banknotes having the short-edge transport orientation. After all the banknotes P to be withdrawn are transported to the withdrawal section 24, the control section 31 controls the temporary storage section 30 and the second, the third, the sixth to the ninth diversion mechanisms 552, 553, 556 to 559 to transport the non-withdrawable banknotes P to the upper reject storage section 28. At this time, the orientation changing unit 6 does not change the orientation of the banknotes P. Thus, the banknotes P are transported to the upper reject storage section 28 while having the short-edge transport orientation.

(Deposit Process from Banknote Transport Cassette)

Figure 5:
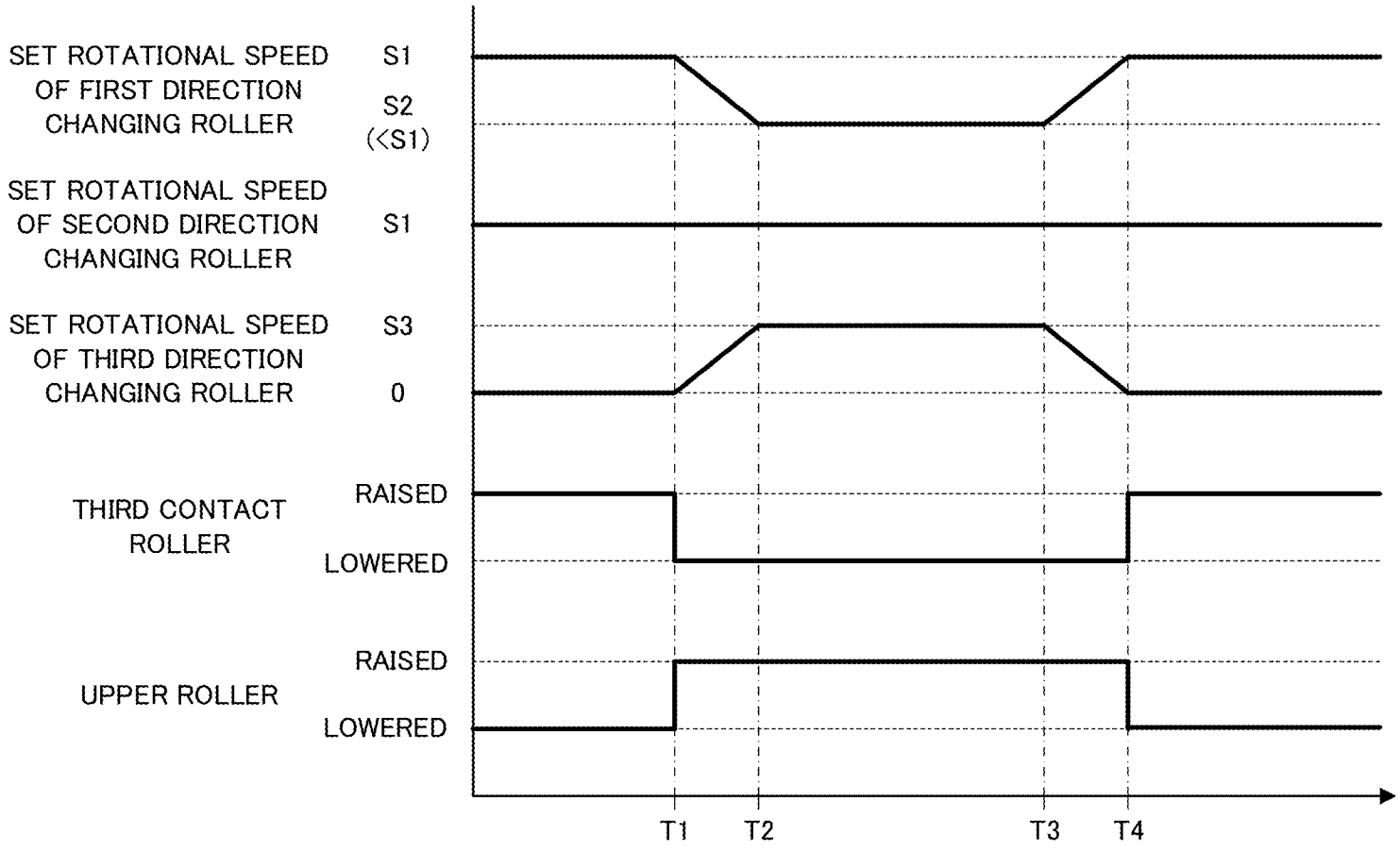
FIG. 5 is a timing chart illustrating a control during a rotation process on the banknote.
Figure 6:
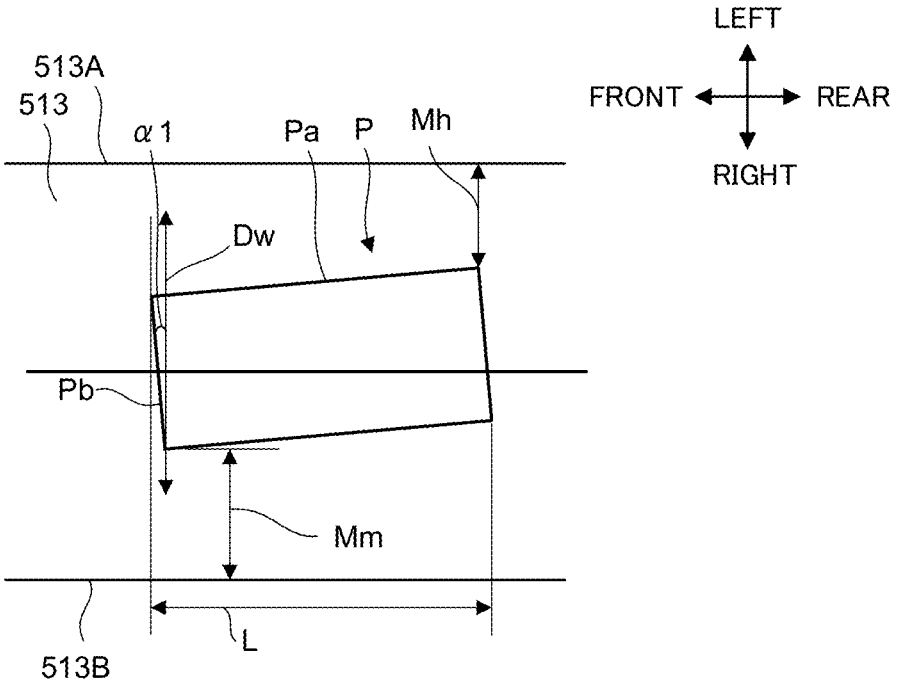
FIG. 6 is an explanatory view for explaining a detection process for detecting the orientation of a banknote being long-edge transported, the length of the banknote in the direction of the transport path, and the position of the banknote in the width direction of the transport path.

Next, the deposit process from the banknote transport cassette 15 will be described. In the deposit process from the banknote transport cassette 15, the control section 31 rotates the banknotes P to change the orientation of the banknotes P being long-edge transported from the banknote transport cassette 15, and stores the banknote P in the first to the sixth storage cassettes 261 to 266 such that the banknote have the short-edge transport orientation. FIG. 5 is a timing chart illustrating a control during a banknote rotation process. FIG. 6 is an explanatory view for explaining a detection process for detecting the orientation of a banknote being long-edge transported, the length of the banknote in the direction of the transport path, and the position of the banknote in the width direction of the transport path. FIGS. 7A, 7B, 7C, 7D, and 7E schematically illustrate the control during the banknote rotation process. FIG. 8 is an explanatory view for explaining a detection process for detecting the orientation of a banknote being short-edge transported, the length of the banknote in the direction of the transport path, and the position of the banknote in the width direction of the transport path.

The operator loads the banknote transport cassette 15 into the cassette loading section 22, and performs an operation of starting the deposit process using the operation section. The control section 31 controls the banknote transport cassette 15, the deposit/withdrawal section 23, the transport section 5, and the third diversion mechanism 553 to transport banknotes P one by one to the orientation changing unit 6. At this time, the banknotes P are fed from the banknote transport cassette 15 while having the long-edge transport orientation, and are transported to the orientation changing unit 6 while keeping the orientation.

In a state where the third contact roller 616 is set to the raised position and the upper rollers 63 are set to the lowered position, the control section 31 transports the banknotes P from the rear to the front of the sheet processing apparatus 1, with the banknotes having the long-edge transport orientation; the control section transports the banknotes by setting the set rotational speed of the first and the second direction changing rollers 611 and 612 to S1, setting the set rotational speed of the third direction changing roller 613 to 0, setting the set rotational speed of the lower rollers 62, for example, to the same speed as the first and the second direction changing rollers 611 and 612, and driving the first and the second direction changing rollers 611 and 612 and the lower rollers 62 as illustrated in FIG. 5. At this time, the banknotes P are transported while making contact with the first to the third direction changing rollers 611 to 613, the first and the second contact rollers 614 and 615, the lower rollers 62, and the upper rollers 63. The third direction changing roller 613 is driven to rotate as a result of making contact with the banknotes P.

As illustrated in FIG. 6, the rear detection section 65 of the orientation changing unit 6 detects the orientation of each of the banknotes P transported, the length L of the banknote P in the direction Dt of the transport path, and the position of the banknote P in the width direction Dw of the transport path. The rear detection section 65 detects the inclination angle $\alpha 1$ of the short side Pb with respect to the width direction Dw of the transport path as the orientation of the banknote P. In other words, the rear detection section 65 detects the inclination angle $\alpha 1$ of the side the banknote P located forward or rearward. The rear detection section 65 detects the shortest distance Mh from the left side wall 513A of the third transport path 513 to the banknote P and the shortest distance Mm from the right side wall 513B of the third transport path 513 to the banknote P as the position of the banknote P in the width direction Dw of the transport path. Note that, the rear detection section 65 may detect, as the position of the banknote P in the width direction Dw of the transport path, a deviation between the middle of the transport path in the width direction Dw of the transport path and the middle of the banknote P. The rear detection section 65 generates a signal indicating detection results, and outputs the signal to the control section 31.

Based on the detection results in the rear detection section 65, the control section 31 determines whether or not to rotate the banknote P. At least one of the following first to the third determination methods can be used as a method of determining whether or not to rotate the banknote P.

In the first determination method, the control section 31 obtains an interval (the shortest distance) between two consecutively transported banknotes P based on the detection results in the rear detection section 65, and when the obtained interval is less than a threshold, the control section determines that the two banknotes P are not rotated. The reason why the two banknotes P are not rotated when the interval between the two banknotes P is less than the threshold is that, there is a possibility that when the two banknotes P are rotated, the two banknotes overlap each other or the interval becomes too narrow, so that the transport and the recognition by the recognition section 25 cannot be performed appropriately. Thereafter, based on the interval between two banknotes P transported following the two banknotes P determined not to be rotated, the control section 31 determines whether or not to rotate the two banknotes P.

On the other hand, when the obtained interval is equal to or greater than the threshold, the control section 31 determines to rotate a front one of the two banknotes P in the deposit transport direction, and then determines, based on the interval between the rear banknote P in the deposit transport direction and a banknote P transported following the banknote P, whether or not to rotate the two banknotes P.

In the second determination method, the control section 31 obtains the interval between two consecutively transported banknotes P based on the detection results in the rear detection section 65. Based on the obtained interval and the positions of the two banknotes P in the width direction Dw of the transport path, the control section 31 obtains an estimation interval between these two banknotes P estimated on the assumption that the two banknotes P are rotated. When the obtained estimation interval is less than a threshold, the control section 31 determines that the two banknotes P are not rotated. Thereafter, based on the estimation interval between two banknotes P transported following the two banknotes P determined not to be rotated, the control section 31 determines whether or not to rotate the two banknotes P.

On the other hand, when the obtained estimation interval is equal to or greater than the threshold, the control section 31 determines to rotate a front one of the two banknotes P in the deposit transport direction, and then determines, based on the estimation interval between the rear banknote P in the deposit transport direction and a banknote P transported following the banknote P, whether or not to rotate the two banknotes P.

In the third determination method, the method of obtaining the estimation interval is different from that in the second determination method, but the method of determining using the estimation interval whether or not to rotate the banknote is the same as the second determination method. In the third determination method, the control section 31 obtains the estimation interval based on the interval between two consecutively transported banknotes P, the positions of the two banknotes P in the width direction Dw of the transport path, and the sizes of the two banknotes P. The sizes of the banknotes P can be obtained based on, for example, the detection results in the rear detection section 65.

The control section 31 controls the orientation changing unit 6 based on the determination result of whether or not to rotate each banknote P and the detection results in the rear detection section 65.

When determining that the banknote P is not to be rotated, the control section 31 controls the transport section 5, the second diversion mechanism 552, and the recognition section 25 to transport the banknote P without causing the orientation changing unit 6 to rotate the banknote P and without causing the recognition section 25 to perform processing on the banknote P, and performs a first reject transport control or a second reject transport control described below.

In the first reject transport control, the control section 31 controls the transport section 5, the second and the sixth to the ninth diversion mechanisms 552 and 556 to 559, and the temporary storage section 30 to temporarily store, in the temporary storage section 30, the banknote P having passed through the recognition section 25. After the processing on all the banknotes P to be deposited ends, the control section 31 controls the temporary storage section 30, the transport section 5, the recognition section 25, the orientation changing unit 6, and the second, the third, and the sixth to the ninth diversion mechanisms 552, 553, and 556 to 559 to feed the banknote P from the temporary storage section 30, and store the fed banknote P in the upper reject storage section 28 without causing the recognition section 25 and the orientation changing unit 6 to perform the recognition process and the rotation process on the fed banknote P, respectively.

In the second reject transport control, the control section 31 controls the transport section 5 and the fourth to the ninth diversion mechanisms 554 to 559 to store, in the counting reject storage section 29, the banknote P having passed through the recognition section 25.

When determining that the banknote P is to be rotated, the control section 31 controls the orientation changing unit 6 based on the detection results in the rear detection section 65 as follows. When the control section 31 determines, for example, based on the detection result in the rear tracking sensors 67, that the banknote P has reached a rotation start position, the control section 31 controls the orientation changing unit 6 to rotate the banknote P. As illustrated in FIG. 5, the control section 31 starts to slow the set rotational speed of the first direction changing roller 611 at the time T1 at which the rotation is started, maintains the speed at S2 slower than S1 during a period between the time T2 and the time T3, and starts to increase the speed at the time T3 to bring it back to S1 at the time T4. The control section 31 maintains the set rotational speed of the second direction changing roller 612 at S1 during a period from the time T1 to T4. During the period from the time T1 to the time T4, the first direction changing roller 611 rotates slower than the second direction changing roller 612. This rotational speed difference between the first direction changing roller 611 and the second direction changing roller 612 causes the banknote P to rotate such that the left edge turns to the rear and the right edge turns to the front as illustrated by the two-dot chain line in FIG. 4. That is, the banknote P rotates such that the end of the banknote on the side of the second direction changing roller 612 rotating faster turns to the front and the end of the banknote on the side of the first direction changing roller 611 rotating slower turns to the rear.

The control section 31 starts to rotate the third direction changing roller 613 in the direction opposite to the first and the second direction changing rollers 611 and 612 at the time T1. That is, the control section 31 starts to rotate the third direction changing roller 613 so as to transport the banknote P rearward. The control section 31 maintains the set rotational speed of the third direction changing roller 613 at S3 during a period from the time T2 to the time T3, and starts to slow the speed at the time T3 to bring the set rotational speed back to 0 at the time T4. The magnitude of the set rotational speed S3 during the period between the time T2 and the time T3 is not particularly limited, but may be equal to the difference between S1 and S2.

The control section 31 lowers the third contact roller 616 to bring the roller into contact with the banknote P during the period between the time T1 and the time T4. This contact makes it more likely for the rotational force of the third direction changing roller 613 to be transmitted to the banknote P.

At the time T4, the control section 31 raises the third contact roller 616 to separate it from the banknote P. By this separation, the banknote P can be smoothly transported.

During the period between the time T1 and the time T4, the control section 31 raises the upper rollers 63 to separate them from the banknote P. By this separation, the banknote P can be smoothly rotated. Further, the inclined surfaces 622A are disposed respectively at both axial ends of each of the lower rollers 62, and the lower roller 62 is disposed such that the upper end 622B is positioned lower than the upper surface of the third transport path 513. Therefore, the rotating banknote P comes into contact with the inclined surfaces 622A of the lower roller 62 and moves along the inclined surfaces 622A. Consequently, the banknote P can be smoothly rotated.

At the time T4, the control section 31 lowers the upper rollers 63 to bring the rollers into contact with the banknote P. This contact makes it possible to prevent the banknote P from rotating excessively due to the inertia of the rotation.

After the time T4 at which the rotation ends, the banknote P is transported forward by the first and the second direction changing rollers 611 and 612 and the lower rollers 62.

In the above-described rotation process on the banknote P, the control section 31 controls the orientation changing unit 6 such that the short side Pb of the rotated banknote P becomes parallel to the direction Dt of the transport path (in other words, the banknote P comes to have the short-edge transport orientation) and the banknote P is located in the middle of the transport path in the width direction Dw, regardless of the orientation of the banknote P, the length L of the banknote P in the direction Dt of the transport path, and the position of the banknote P in the width direction Dw of the transport path detected in the rear detection section 65. Note that, in the following description, a "state where the banknote P has the short-edge transport orientation and the banknote P (the middle of the short side Pb of the banknote P) is located in the middle of the transport path in the width direction Dw" may be referred to as a "deposit target state."

Figure 7A:
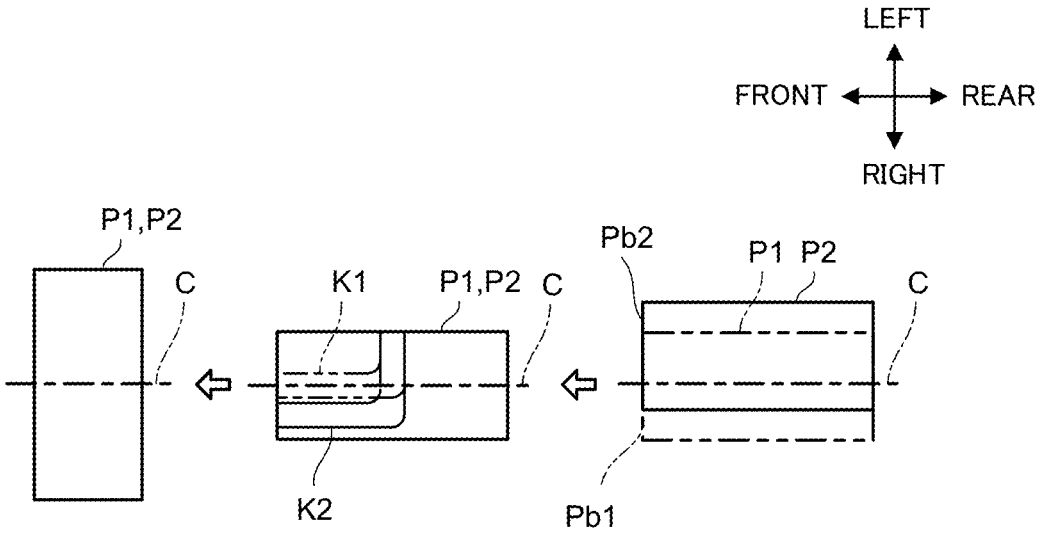
FIG. 7A schematically illustrates a control during the rotation process on the banknote.

For example, as illustrated by the two-dot chain line in a right figure in FIG. 7A, when a banknote P1 before rotation is located in the middle of the transport path in the width direction Dw, and the inclination angle α1 of the short side Pb1 is 0°, the control section 31 brings the rotated banknote P1 into the deposit target state as illustrated by the solid line in a left figure by rotating the banknote P1 such that the track of the contact position between the first and the second direction changing rollers 611 and 612 and the banknote P1 (hereinafter, "the track of the contact position between the first and the second direction changing rollers 611 and 612 and the banknote P" may be referred to as "contact track") K1 is as illustrated by the two-dot chain line in a central figure. Note that, a reference sign C in FIG. 7A and below-described FIGS. 7B, 7C, 7D, and 7E expresses a line passing through the middle of the transport path in the width direction Dw and being parallel to the direction Dt of the transport path.

As illustrated by the solid line in the right figure in FIG. 7A, when the size of a banknote P2 is the same as the size of the banknote P1, when the middle of the banknote P2 before rotation is located on the left side of the middle of the transport path in the width direction Dw, and when the inclination angle α1 of the short side Pb2 is 0°, the control section 31 brings the rotated banknote P2 into the deposit target state as illustrated by the solid line in the left figure by rotating the banknote P2 such that a contact track K2 is as illustrated by the solid line in the central figure.

As illustrated in FIG. 7A, when the sizes are the same, when the inclination angles α1 of the short sides Pb are 0°, and when only the positions in the width direction Dw of the transport path are different, the control section 31 can bring the rotated banknotes P1 and P2 into the deposit target state by controlling the first and the second direction changing rollers 611 and 612 in the same way between the banknote P1 and the banknote P2.

Figure 7B:
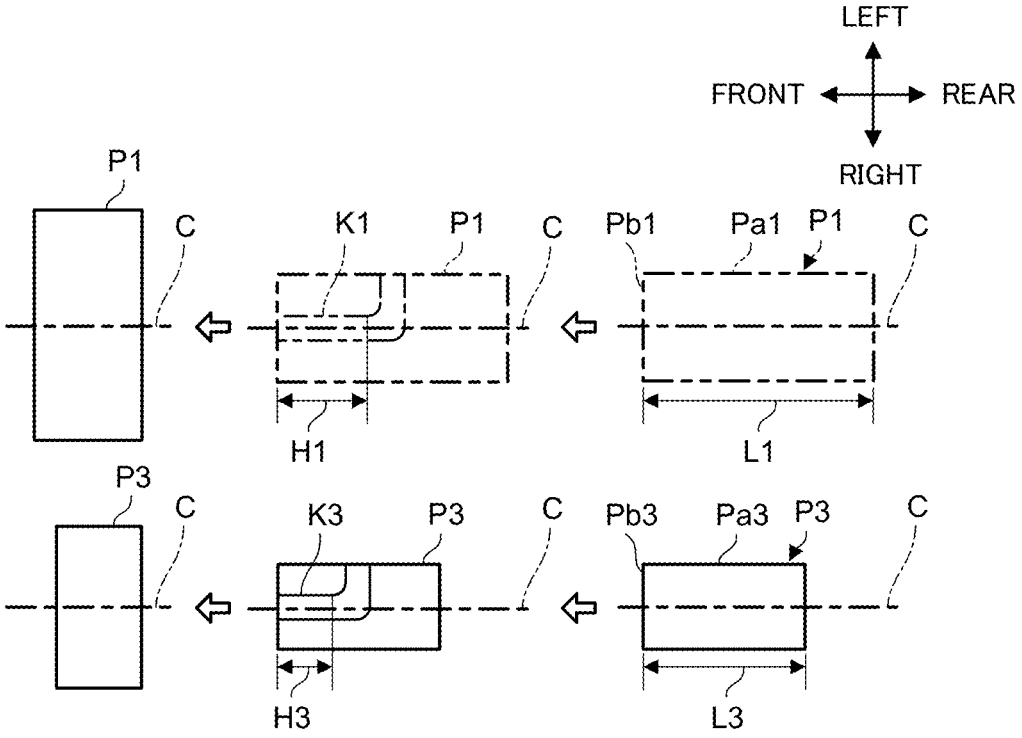
FIG. 7B schematically illustrates a control during the rotation process on the banknote.
Figure 8:
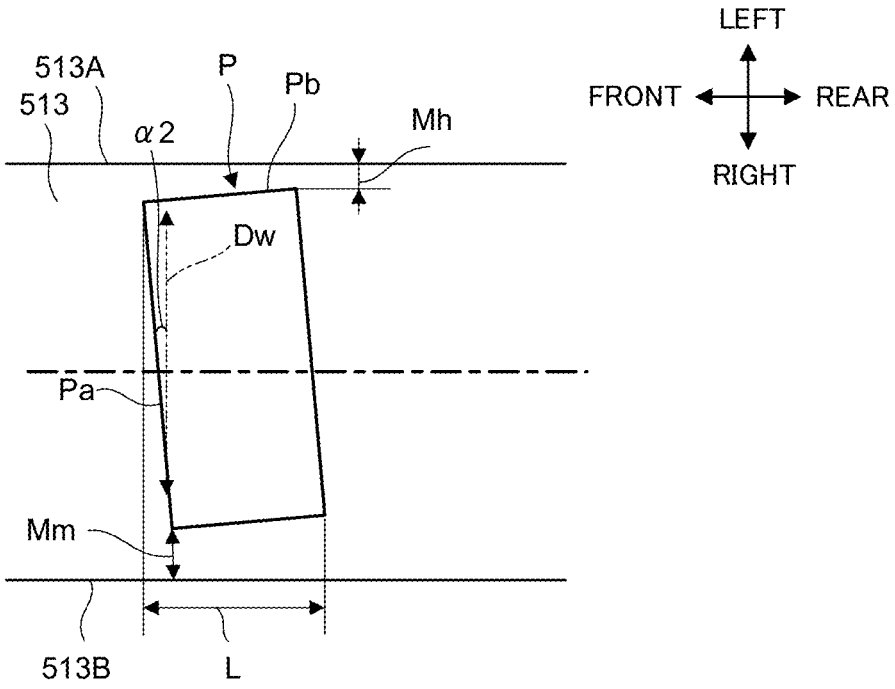
FIG. 8 is an explanatory view for explaining a detection process for detecting the orientation of a banknote being short-edge transported, the length of the banknote in the direction of the transport path, and the position of the banknote in the width direction of the transport path.

Next, another case will be described based on FIG. 7B. The three figures at the upper side in FIG. 7B illustrate the rotation control for the banknote P1 in FIG. 7A. As illustrated by the solid line in the lower right figure in FIG. 7B, when the length L3 of the long side Pa3 of a banknote P3 is shorter than the length L1 of the long side Pa1 of the banknote P1, when the banknote P3 before rotation is located in the middle of the transport path in the width direction Dw, and when the inclination angle α1 of the short side Pb3 is 0°, the control section 31 brings the rotated banknote P3 into the deposit target state as illustrated by the solid line in the lower left figure by rotating the banknote P3 such that a contact track K3 is as illustrated by the solid line in the lower central figure.

As illustrated in FIG. 7B, the control section 31 controls the first and the second direction changing rollers 611 and 612 such that the distance through which the banknote P3 moves in the direction Dt of the transport path until the first and the second direction changing rollers 611 and 612 start to rotate the banknote P3 after the rollers make contact with the banknote P3 (hereinafter, the "distance through which the banknote P moves in the direction Dt of the transport path until the first and the second direction changing rollers 611 and 612 start to rotate the banknote P after the rollers make contact with the banknote P" may be referred to as "linear transport distance") H3 is shorter than a linear transport distance H1 for the banknote P1. That is, when the lengths L of the banknotes Pin the direction Dt of the transport path are different from each other and the inclination angles α1 of the short sides Pb are 0°, the control section 31 can bring the banknotes P into the deposit target state by using different linear transport distances depending on the lengths L. Note that, even when the banknote P3 before rotation is not located in the middle of the transport path in the width direction Dw, the control section 31 can bring the rotated banknote P3 into the deposit target state by performing the same control as in the lower central figure in FIG. 7B.

Next, still another case will be described with reference to FIG. 7C. The two-dot chain line in FIG. 7C indicates the rotation control of the banknote P1 in FIG. 7A. As illustrated by the solid line in the right figure in FIG. 7C, when the size of a banknote P4 is the same as the size of the banknote P1, when the middle of the banknote P4 before rotation is deviated from the middle of the transport path in the width direction Dw, and when the banknote P4 is rotated with respect to the state of the banknote P1 in the direction opposite to the rotation direction of rotation performed by the orientation changing unit 6, the inclination angle α1 of the short side Pb4 exceeds 0°, and the length L4 of the banknote P4 in the direction Dt of the transport path is longer than the length L1 of the banknote P1 in the direction Dt of the transport path. In this case, the control section 31 brings the rotated banknote P4 into the deposit target state as illustrated by the solid line in the left figure by rotating the banknote P4 such that a contact track K4 is as illustrated by the solid line in the central figure.

Figure 7C:
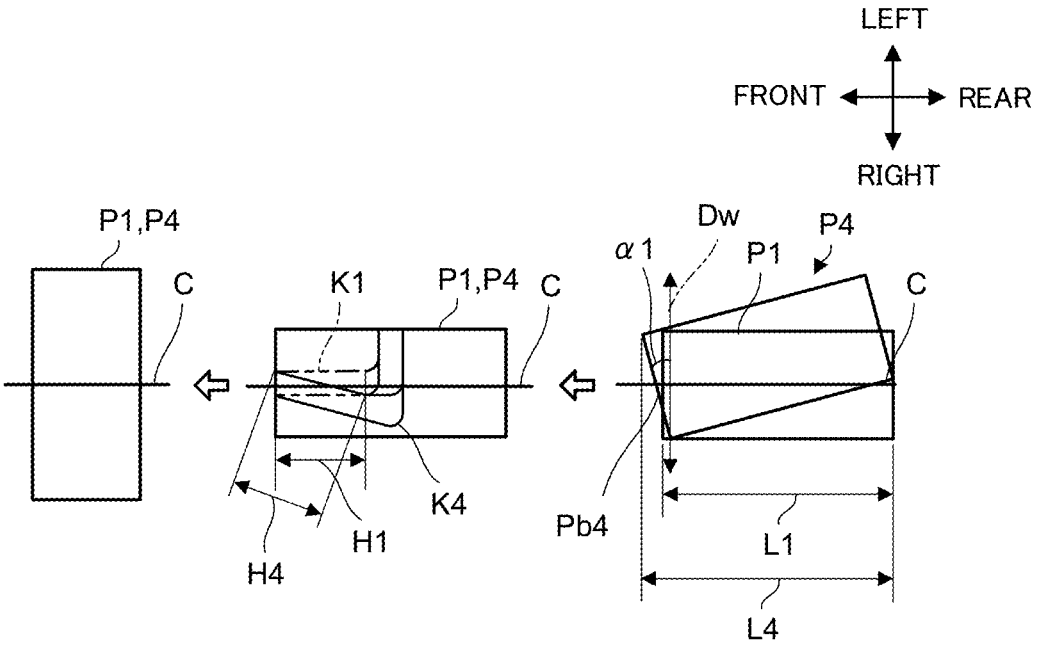
FIG. 7C schematically illustrates a control during the rotation process on the banknote.

As illustrated in FIG. 7C, the control section 31 controls the first and the second direction changing rollers 611 and 612 such that a linear transport distance H4 is longer than the linear transport distance H1 of the banknote P1 and the rotation angle of the banknote P4 is larger than the rotation angle of the banknote P1. That is, when the lengths L of the banknotes P in the direction Dt of the transport path are different from each other and the banknote P4 is rotated with respect to the state of the banknote P1 in the direction opposite to the rotation direction of rotation performed by the orientation changing unit 6, the control section 31 can bring the banknotes P into the deposit target state by using different linear transport distances depending on the lengths L and increasing the rotation angle depending on the inclination angle α1 before rotation. Adjustment of the rotation angle can be performed by adjusting the length from the time T1 of the rotation start to the time T4 of the end, and/or the speed difference between the first and the second direction changing rollers 611 and 612. Note that, even when the banknote P4 before rotation is deviated from the position illustrated in FIG. 7C in the width direction Dw of the transport path, the control section 31 can bring the rotated banknote P4 into the deposit target state by performing the same control as that in the central figure in FIG. 7C.

Next, still another case will be described with reference to FIG. 7D. The two-dot chain line in FIG. 7D indicates the rotation control of the banknote P1 in FIG. 7A. As illustrated by the solid line in the right figure in FIG. 7D, when the size of a banknote P5 is the same as the size of the banknote P1, when the middle of the banknote P5 before rotation is deviated from the middle of the transport path in the width direction Dw, and when the banknote P5 is rotated with respect to the state of the banknote P1 in the same direction as the rotation direction of rotation performed by the orientation changing unit 6, the inclination angle α1 of the short side Pb5 exceeds 0°, and the length L5 of the banknote P5 in the direction Dt of the transport path is longer than the length L1 of the banknote P1 in the direction Dt of the transport path. In this case, the control section 31 brings the rotated banknote P5 into the deposit target state as illustrated by the solid line in the left figure by rotating the banknote P5 such that a contact track K5 is as illustrated by the solid line in the central figure.

Figure 7D:
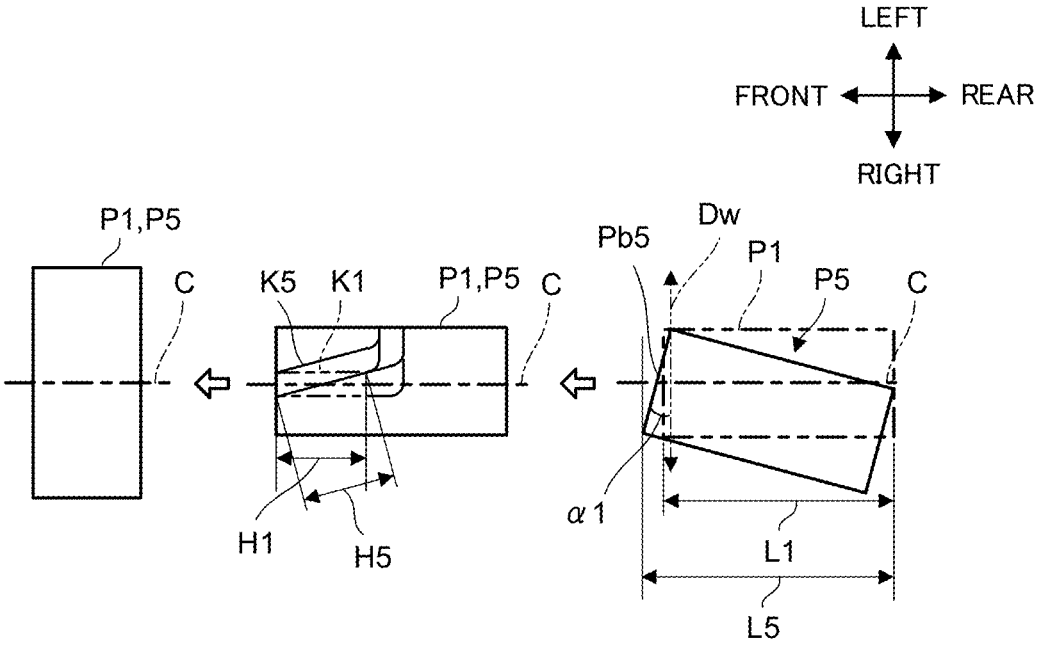
FIG. 7D schematically illustrates a control during the rotation process on the banknote.

As illustrated in FIG. 7D, the control section 31 controls the first and the second direction changing rollers 611 and 612 such that the linear transport distance H5 is smaller than the linear transport distance H1 of the banknote P1 and the rotation angle of the banknote P5 is larger than the rotation angle of the banknote P1. That is, when the lengths L of the banknotes P in the direction Dt of the transport path are different from each other and the banknote P5 is rotated with respect to the state of the banknote P1 in the same direction as the rotation direction of rotation performed by the orientation changing unit 6, the control section 31 can bring the banknotes P into the deposit target state by using different linear transport distances depending on the lengths L and decreasing the rotation angle depending on the inclination angle α1 before rotation.

Next, a method of controlling the orientation changing unit 6 such that the short side Pb of the rotated banknote P becomes parallel to the direction Dt of the transport path and the banknote P is located at a position deviated from the middle of the transport path in the width direction Dw to the left or right will be described based on FIG. 7E. The two-dot chain line in FIG. 7E indicates the rotation control of the banknote P1 in FIG. 7A. As illustrated by the solid line in the right figure in FIG. 7E, when the orientation of a banknote P6 before the rotation having the same size as the banknote P1 is the same as the banknote P1 and the positions in the width direction Dw of the transport path are the same, the control section 31 brings the rotated banknote P6 into a state deviated on the left side from the deposit target state as illustrated by the solid line in the left figure by rotating the banknote P6 such that a contact track K6 is as illustrated by the solid line in the central figure. That is, the control section 31 rotates the banknote P6 such that the linear transport distance H6 of the banknote P6 is longer than the linear transport distance H1 of the banknote P1.

Figure 7E:
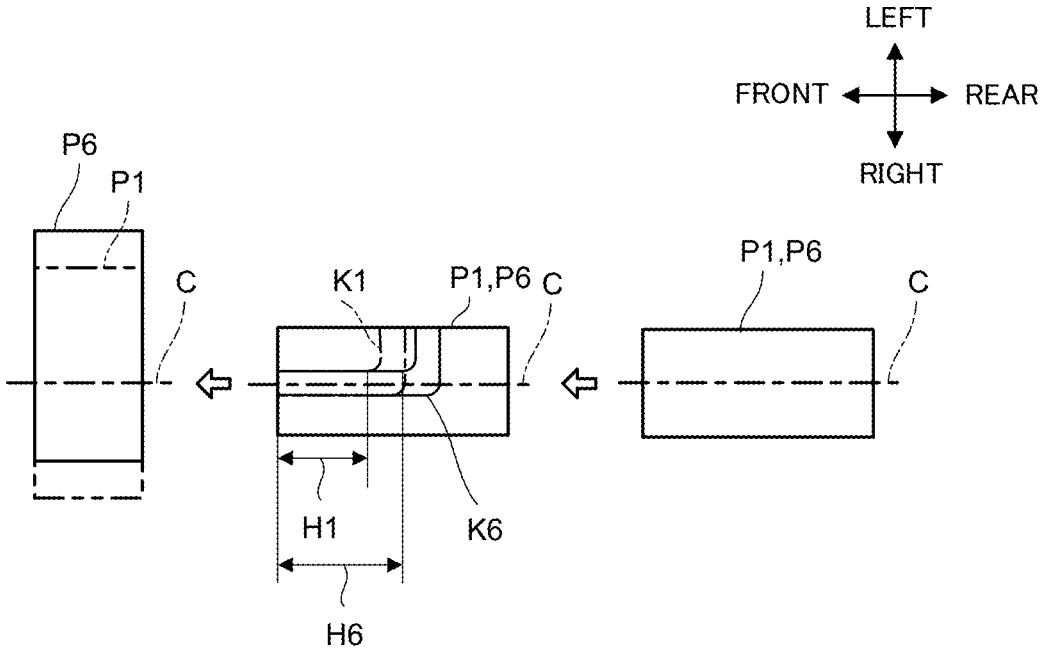
FIG. 7E schematically illustrates a control during the rotation process on the banknote.

As illustrated in FIG. 7E, the control section 31 controls the first and the second direction changing rollers 611 and 612 such that the linear transport distance H6 is longer than the linear transport distance H1 of the banknote P1. That is, when the lengths L of the banknotes P in the direction Dt of the transport path are the same, the control section 31 can adjust the positions of the rotated banknotes P in the width direction Dw of the transport path by adjusting the linear transport distances H.

As illustrated in FIGS. 7A to 7E, the control section 31 is configured to be capable of changing the orientation of the banknote P from the long-edge transport orientation to the short-edge transport orientation by rotating the banknote P by 90±20°, or from the short-edge transport orientation to the long-edge transport orientation as described later. When the rotation process on the banknote P ends, the control section 31 determines whether or not the orientation of the banknote P is in the deposit target state, that is, whether or not the banknote P has the short-edge transport orientation and the banknote P is located in the middle of the transport path in the width direction Dw. The detection results for the banknote P in the front detection section 64 or the recognition section 25 can be used for this determination.

For example, as illustrated in FIG. 8, the front detection section 64 detects the orientation of the rotated banknote P and the position of the banknote P in the width direction Dw of the transport path. The front detection section 64 detects, as the orientation of the banknote P, the inclination angle α2 of the long side Pa with respect to the width direction Dw of the transport path. That is, the front detection section 64 detects the inclination angle α2 of the side of the banknote P positioned in the front or in the rear. The front detection section 64 detects the shortest distance Mh from the left side wall 513A of the third transport path 513 to the banknote P and the shortest distance Mm from the right side wall 513B to the banknote P as the position of the banknote P in the width direction Dw of the transport path. Note that, the front detection section 64 may detect, as the position of the banknote P in the width direction Dw of the transport path, a deviation between the middle of the transport path in the width direction Dw of the transport path and the middle of the banknote P. In addition, the recognition section 25 may also detect the orientation of the rotated banknote P and the position of the banknote P in the width direction Dw of the transport path by the same process as the front detection section 64.

The control section 31 determines whether or not the inclination angle α2 is an angle at which the banknote P can be regarded as having the short-edge transport orientation, that is, whether or not the deviation of the inclination angle α2 from 0° is less than an allowable angle. The control section 31 determines whether or not the position of the banknote P in the width direction Dw of the transport path can be regarded as the position in the middle of the transport path in the width direction Dw, that is, whether or not the deviation of the banknote P from the middle of the transport path in the width direction Dw is less than an allowable deviation amount.

When the deviation of the inclination angle $\alpha 2$ from 0° is less than the allowable angle and the deviation of the banknote P from the middle of the transport path in the width direction Dw is less than the allowable deviation amount, the control section 31 determines that the banknote P is in the deposit target state. When the deviation of the inclination angle $\alpha 2$ from 0° is equal to or greater than the allowable angle, or when the deviation of the banknote P from the middle of the transport path in the width direction Dw is equal to or greater than the allowable deviation amount, the control section 31 determines that the banknote P is not in the deposit target state.

When determining that the rotated banknote P is not in the deposit target state, the control section 31 performs the first reject transport control or the second reject transport control described above.

When determining that the rotated banknote P is in the deposit target state, the control section 31 causes the recognition section 25 to recognize the banknote P. Note that, the front detection section 64 may also have a function of recognizing the banknote P. When determining that the banknote P is a depositable banknote, the control section 31 controls the transport section 5, the seventh to the twelfth diversion mechanisms 557 to 562, and the first to the sixth storage cassettes 261 to 266 to store the banknote P in the first to the sixth storage cassettes 261 to 266 by denomination. At this time, the banknotes P are stored in the first to the sixth storage cassettes 261 to 266 while having the short-edge transport orientation. That is, the banknotes P deposited from the banknote transport cassette 15 are stored in the first to the sixth storage cassettes 261 to 266 while having the same orientation as the banknotes P deposited from the deposit section 21. When determining that the banknote P is a non-depositable banknote, the control section 31 performs the first reject transport control or the second reject transport control described above.

(Withdrawal Process to Banknote Transport Cassette)

Figure 9A:
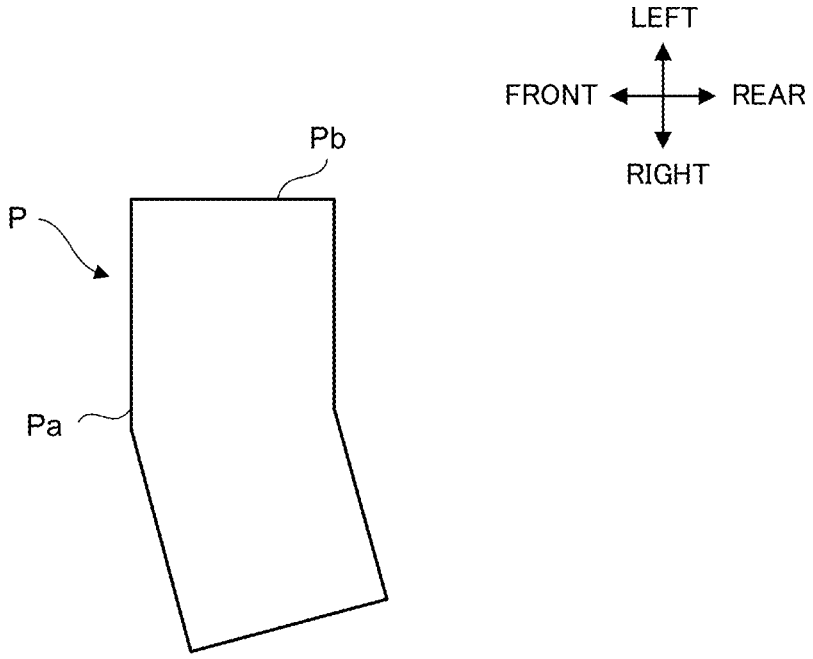
FIG. 9A is an explanatory view for explaining a problem that may occur when a banknote is rotated.
Figure 9B:
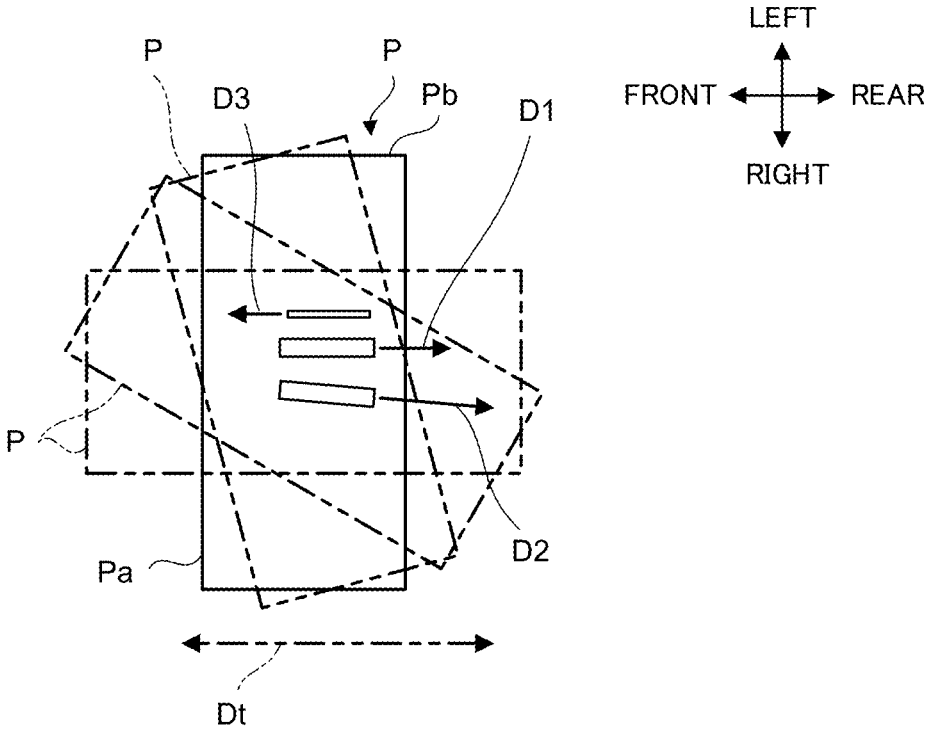
FIG. 9B is an explanatory view of a method for solving the problem of FIG. 9A.

Next, the withdrawal process to the banknote transport cassette 15 will be described. In the withdrawal process to the banknote transport cassette 15, the sheet processing apparatus 1 stores, in the banknote transport cassette 15, those banknotes P which are fed from the first to the sixth storage cassettes 261 to 266 while having the short-edge transport orientation, such the banknotes P have the long-edge transport orientation. FIG. 9A is an explanatory view for explaining a problem that may occur when a banknote is rotated. FIG. 9B is an explanatory view for explaining a process for resolving the problem of FIG. 9A.

The operator performs an operation of starting the withdrawal process of a predetermined number of banknotes P of predetermined denominations. The control section 31 controls the first to the sixth storage cassettes 261 to 266, the transport section 5, and the seventh to the twelfth diversion mechanisms 557 to 562 to transport the banknotes P one by one to the recognition section 25. At this time, the banknotes P are transported to the recognition section 25 while having the short-edge transport orientation. The recognition section 25 recognizes the banknotes P sequentially transported, generates a signal indicating the recognition result, and outputs the signal to the control section 31. Based on the received signal, the control section 31 determines whether each of the banknotes P is a withdrawable banknote P or a non-withdrawable banknote P.

When determining that the banknote P is the non-withdrawable banknote P, the control section 31 controls the transport section 5, the orientation changing unit 6, and the second and the third diversion mechanism 552 and 553, to store the banknote in the upper reject storage section 28 without causing the orientation changing unit 6 to perform any process on the banknote P.

When determining that the banknote P is the withdrawable banknote, the control section 31 determines whether or not to rotate the banknote P as in the deposit process from the banknote transport cassette 15. At least one of the above first to the third determination methods can be used as a method of determining whether or not to rotate the banknote P. Note that, in the withdrawal process, the control section 31 performs processes based on the first to the third determination methods based on the detection results for the banknote P in the front detection section 64 or the recognition section 25. In addition, the control section 31 obtains the interval between the banknotes P being short-edge transported.

When determining, by one of the first to the third determination methods, not to rotate two consecutively transported banknotes P, the control section 31 controls the orientation changing unit 6 and the second and the third diversion mechanisms 552 and 553 to store the two banknotes P in the upper reject storage section 28 without causing the orientation changing unit 6 to rotate the two banknotes P.

When determining, by at least one of the first to the third determination methods, that a front one of the two consecutively transported banknotes P in the withdrawal transport direction is to be rotated, the control section 31 controls the orientation changing unit 6 to rotate the banknote P to change the orientation of the banknote P from the short-edge transport orientation to the long-edge transport orientation. At this time, the control section 31 performs the same control as the control performed in the deposit process based on FIG. 5 and FIGS. 7A to 7E, thereby changing the orientation of the banknote P such that the long side Pa of the rotated banknote P becomes parallel to the direction Dt of the transport path, that is, such that the banknote P comes to have the long-edge transport orientation and the banknote P is located in the middle of the transport path in the width direction Dw, regardless of the orientation of the banknote P, the length L of the banknote P in the direction Dt of the transport path, and the position of the banknote P in the width direction Dw of the transport path. Note that, in the following description, the "state where the banknote P has the long-edge transport orientation and the banknote P (the middle of the long side Pa of the banknote P) is located in the middle of the transport path in the width direction Dw" may be referred to as a "withdrawal target state." In the withdrawal process, the control section 31 rotates the first to the third direction changing rollers 611 to 613 and the lower roller 62 in directions opposite to those in the deposit process. Note that, the orientation of the banknote P, the length L of the banknote P in the direction Dt of the transport path, and the position of the banknote P in the width direction Dw of the transport path may be detected by the front detection section 64 or may be detected by the recognition section 25. In addition, the set rotational speeds of the first to the third direction changing rollers 611 to 613 and the lower rollers 62 during the withdrawal process may be the same as or different from those during the deposit process. The position of the rotated banknote P in the width direction Dw of the transport path may not be in the middle.

When the banknote P is rotated from the short-edge transport orientation to the long-edge transport orientation, the banknote P is rotated such that the right edge (the edge on the lower side in FIG. 4) of the banknote P during withdrawal as seen from the rear side (the left side in FIG. 4) faces forward in the withdrawal transport direction and the left edge (the edge on the upper side in FIG. 4) faces rearward in the withdrawal transport direction as illustrated in FIG. 4. Forward inertia in the withdrawal transport direction acts on the banknote P entirely. At the right edge side of the banknote P, the moving direction during rotation and the direction of action of inertia is substantially the same. However, at the left edge side of the banknote P, the moving direction during rotation and the direction of action of inertia is opposite to each other. Therefore, as illustrated in FIG. 9A, the left edge side of the banknote P is less easily to rotated than the right edge side, and the banknote P may bend and may be wrinkled. Further, since the left edge side is difficult to be rotated, the entire banknote P is also difficult to be rotated, and there is a possibility that the banknote P does not take a desired orientation due to insufficient rotation.

Therefore, in the present embodiment, in order to prevent the occurrence of such a problem, the following two configurations are applied.

The first configuration is a configuration in which the withdrawal transport direction D2 of the second direction changing roller 612 is inclined by an angle θ with respect to the direction Dt of the transport path as illustrated in FIGS. 2, 3A, 4, and 9B. In FIG. 9B, arrows indicating the withdrawal transport directions of the first to the third direction changing rollers 611 to 613 represent transporting speeds (rotational speeds) by their sizes.

In such a first configuration, the right edge side of the banknote P is pulled more obliquely to the right forward side by the second direction changing roller 612 during rotation of the banknote P than in the case where the withdrawal transport direction D2 is parallel to the direction Dt of the transport path. Consequently, the occurrence of wrinkles in the banknote P is prevented, and the banknote P is prevented from not taking a desired orientation due to insufficient rotation. In order to obtain such an effect, the angle θ may be a value within the range of 5±2°.

The second configuration is a configuration in which the third direction changing roller 613 is driven during rotation of the banknote P as illustrated in FIGS. 5 and 9B. The control section 31 starts to rotate the third direction changing roller 613 in the direction opposite to the rotation direction of the first and the second direction changing rollers 611 and 612 at the time T1. That is, the control section 31 starts to rotate the third direction changing roller 613 so as to transport the banknote P rearward in the withdrawal transport direction. The control section 31 maintains the set rotational speed of the third direction changing roller 613 at S3 during a period from the time T2 to the time T3, and starts to slow the speed at the time T3 to bring the set rotational speed back to 0 at the time T4.

In such a second configuration, since the third direction changing roller 613 actively rotates the banknote P such that the left edge side moves rearward in the withdrawal transport direction, the occurrence of wrinkles in the banknote P is prevented, and the banknote P is prevented from not taking a desired orientation due to insufficient rotation.

When the rotation process on the banknote P ends, the control section 31 determines whether or not the orientation of the banknote P is in the withdrawal target state, that is, whether or not the banknote P has the long-edge transport orientation and the banknote P is located in the middle of the transport path in the width direction Dw. The detection results for the banknote P in the rear detection section 65 can be used for this determination.

For example, the rear detection section 65 detects the orientation of the rotated banknote P (the inclination angle α1 of the short side Pb with respect to the width direction Dw of the transport path) and the position of the banknote P in the width direction Dw of the transport path as illustrated in FIG. 6 in the same manner as in the deposit process.

The control section 31 determines whether or not the inclination angle α1 is an angle at which the banknote P can be regarded as having the long-edge transport orientation, that is, whether or not the deviation of the inclination angle α1 from 0° is less than an allowable angle. The control section 31 determines whether or not the position of the banknote P in the width direction Dw of the transport path can be regarded as the position in the middle of the transport path in the width direction Dw, that is, whether or not the deviation from the middle position of the transport path in the width direction Dw is less than an allowable deviation amount.

When the deviation of the inclination angle α1 from 0° is less than the allowable angle and the deviation from the middle position of the transport path in the width direction Dw is less than the allowable deviation amount, the control section 31 determines that the banknote P is in the withdrawal target state. When the deviation of the inclination angle α1 from 0° is equal to or greater than the allowable angle, or when the deviation from the middle position of the transport path in the width direction Dw is equal to or greater than the allowable deviation amount, the control section 31 determines that the banknote P is not in the withdrawal target state.

When determining that the rotated banknote P is not in the withdrawal target state, the control section 31 controls the transport section 5 and the third diversion mechanism 553 to store the banknote P in the upper reject storage section 28.

When determining that the rotated banknote P is in the withdrawal target state, the control section 31 controls the transport section 5, the third diversion mechanism 553, the deposit/withdrawal section 23, and the banknote transport cassette 15 to store one banknote P after another in the banknote transport cassette 15. At this time, the banknotes P are stored in the banknote transport cassette 15 while having the long-edge transport orientation.

The sheet transport apparatus 4 stores, in the storage section 26, banknotes P inserted in the deposit section 21 (first reception section) while having the short-edge transport orientation (first orientation), in which case the sheet transport apparatus the banknotes in the storage section without changing the orientation of the banknotes. The sheet transport apparatus 4 changes, to the short-edge transport orientation by the orientation changing unit 6, the orientation of banknotes P that are inserted in the sheet transport apparatus from the banknote transport cassette 15 via the deposit/withdrawal section 23 (second reception section) while having the long-edge transport orientation (second orientation), and stores the banknotes P in the storage section 26. It is thus possible to store the banknotes P in the storage section 26, with the banknotes having the same orientation between those banknotes which are inserted into the sheet transport apparatus 4 while having the short-edge transport orientation and those banknotes which are inserted into the sheet transport apparatus 4 while having the long-edge transport orientation.

The sheet transport apparatus 4 changes the orientations of the banknotes P from one of the long-edge transport orientation and the short-edge transport orientation to the other one of the long-edge transport orientation and the short-edge transport orientation using the rotational speed difference between the first direction changing roller 611 and the second direction changing roller 612. It is thus possible to change the long-edge transport orientation to the short-edge transport orientation by one rotation process using the first direction changing roller 611 and the second direction changing roller 612, so as to prevent the enlargement of the sheet transport apparatus 4. Further, the control for the rotation process is facilitated.

When rotating each of the banknotes P, the sheet transport apparatus 4 changes the rotational speed of the first direction changing roller 611 to a speed different from the rotational speed before and after changing the orientation of the banknote P, and does not change the rotational speed of the second direction changing roller 612 from the rotational speed before and after changing the orientation of the banknote P. Thus, since the rotational speed of only the first direction changing roller 611 is changed, the control for rotating the banknote P is facilitated.

The second direction changing roller 612 is disposed to transport the banknote P in a direction diverging away from the first direction changing roller 611 downstream (toward the rear side) along the third transport path 513 in the case where the banknote P is transported rearward in the sheet processing apparatus 1. It is thus possible to prevent the occurrence of wrinkles in the banknote P when the banknote P transported rearward in the sheet processing apparatus 1 is rotated, and to prevent the banknote P from not being brought into a desired orientation due to insufficient rotation.

The outer peripheral surfaces 614A and 615A of the first and the second contact rollers 614 and 615 in the sections along the respective axes of rotation are formed in a curved surface shape. It is thus possible to reduce the contact area between the first and the second contact rollers 614 and 615 and the banknote P, so as to rotate the banknote P smoothly. In addition, even when variations of parts or the like of the first and the second contact rollers 614 and 615 cause the rollers to be fixed in a tilted manner differently from the state as designed, the contact state between the first and the second contact rollers 614 and 615 and the banknote P can be in the same state as in the case where the first and the second contact rollers are fixed as designed.

When the banknote P is not to be rotated, the sheet transport apparatus 4 controls the lower rollers 62 and the upper rollers 63 to bring the rollers into a first state in which the rollers are in contact with the banknote P, and when the banknote P is to be rotated, the upper rollers 63 are controlled to be brought into a second state in which the rollers are not in contact with the banknote P. It is thus possible to transport the banknote P smoothly by the lower rollers 62 and the upper rollers 63 when the banknote P is not to be rotated. Since the upper rollers 63 do not make contact with the banknote P when the banknote P is to be rotated, it is possible to eliminate a risk of breakage of the banknote P during rotation, which might occur when the upper rollers 63 is kept in contact with the banknote P, and in addition, it is possible to rotate the banknote P smoothly.

The sheet transport apparatus 4 separates the upper rollers 63 from the banknote P at the same time as the start of rotation of the banknote P. It is thus possible to transport the banknote P smoothly by the contact by the lower rollers 62 and the upper rollers 63 until the rotation of the banknote P is started.

The sheet transport apparatus 4 brings the upper rollers 63 into contact with the banknote P at the same time as the end of rotation of the banknote P. It is thus possible to prevent the banknote P from rotating excessively due to inertia at the time of rotation.

Each of the lower rollers 62 is provided with the inclined surfaces 622A inclined to come closer to the axis of the lower roller 62 toward the outside of the lower roller 62 in the axial direction. It is thus possible to cause the rotating banknote P to make contact with the inclined surfaces 622A of the lower roller 62 to move the banknote along the inclined surfaces 622A. Consequently, the banknote P can be smoothly rotated.

When the banknote P is to be rotated, the sheet transport apparatus 4 brings the third direction changing roller 613 and the third contact roller 616 into contact with the banknote P, and rotates the third direction changing roller 613 in the direction opposite to the rotation direction of the first and the second direction changing rollers 611 and 612, and when the sheet is not to be rotated, the third contact roller 616 is not brought into contact with the banknote P. It is thus possible to prevent the occurrence of wrinkles in the banknote P when the banknote is to be rotated, and to prevent the banknote P from not being brought into a desired orientation due to insufficient rotation. When the banknote P is not to be rotated, the banknote P can be smoothly transported.

The sheet transport apparatus 4 is configured to change the orientation of the banknote P from, for example, the long-edge transporting orientation to the short-edge transport orientation by rotating the banknote P by 90±20°. Thus, even when the long-edge transported banknotes P4 and P5 are inclined as illustrated in the right figure in FIG. 7C or 7D, the banknotes can be brought into the short-edge transport orientation as illustrated in the left figures in FIG. 7C or 7D.

The sheet transport apparatus 4 obtains the interval (first interval) between two consecutively transported banknotes P based on the detection results in the rear detection section 65 (second detection section) during the deposit process from the banknote transport cassette 15, and when the obtained interval is less than the threshold (first threshold), determines not to rotate the two banknotes P. When the sheet transport apparatus 4 determines not to rotate the banknote P and performs the first reject transport control, the sheet transport apparatus 4 controls the transport section 5 and the second and the sixth to the ninth diversion mechanisms 522 and 556 to 559 (second diversion section) to temporarily store, in the temporary storage section 30, the two banknotes P determined not to be rotated, and after the processing on all the banknotes P to be deposited ends, controls the transport section 5, the second and the sixth to the ninth diversion mechanisms 522 and 556 to 559, and the third diversion mechanism 553 (first diversion section) to store, in the upper reject storage section 28 (first reject storage section), the banknotes P temporarily stored in the temporary storage section 30. When the sheet transport apparatus 4 determines not to rotate the banknotes P and performs the second reject transport control, the sheet transport apparatus 4 controls the transport section 5 and the second and the fourth to the ninth diversion mechanisms 522 and 554 to 559 (third diversion section) to store, in the counting reject storage section 29 (second reject storage section), the two banknotes P determined not to be rotated. It is thus possible to prevent a problem that the transport and the recognition of the recognition section 25 cannot be performed appropriately, which might occur when two banknotes P the interval between which is less than the threshold are rotated.

The sheet transport apparatus 4 detects the orientation of the banknote P by the rear detection section 65 (detection section) during the deposit process from the banknote transport cassette 15, and changes the orientation of the banknote P from the long-edge transport orientation to the short-edge transport orientation based on the detection result. The sheet transport apparatus 4 detects the orientation of the banknote P by the front detection section 64 or the recognition section 25 during the withdrawal process to the banknote transport cassette 15, and changes the orientation of the banknote P from the short-edge transport orientation to the long-edge transport orientation based on the detection result. It is thus possible to change the orientation of the banknote P to a desired orientation regardless of the orientation of the banknote P before rotation by controlling the rotational state of the banknote P in accordance with the orientation of the banknote P before rotation.

During the deposit process from the banknote transport cassette 15, the sheet transport apparatus 4 detects the length L of the banknote P in the direction Dt of the transport path by the rear detection section 65 (detection section), and based on this detection result, adjusts the linear transport distance H of the banknote P, that is, the timing of the start of rotation of the banknote P such that the rotated banknote P is located at a predetermined position in the width direction Dw of the transport path. During the withdrawal process for withdrawal from the banknote transport cassette 15, the sheet transport apparatus 4 detects the length L of the banknote P in the direction Dt of the transport path by the front detection section 64 or the recognition section 25, and based on this detection result, adjusts the linear transport distance H of the banknote P such that the rotated banknote P is located at a predetermined position in the width direction Dw of the transport path. Therefore, even when the banknote P before rotation is inclined or the banknote P having a different size is transported, the position of the rotated banknote P in the width direction Dw of the transport path can be a predetermined position. It is thus possible to prevent collision of the rotated banknote P with the side wall of the transport path, so as to transport the banknote P smoothly.

The sheet processing apparatus 1 is provided with the cassette loading section 22 into which the banknote transport cassette 15 (first cassette) is loaded. It is thus possible to enhance the efficiency of the deposit process using the banknote transport cassette 15 having a mechanism for outletting the stored banknotes P.

Based on the detection result for the banknote P in the front detection section 64 (first detection section) or the recognition section 25 (first detection section), the sheet transport apparatus 4 determines whether or not the orientation of the rotated banknote P during the deposit process from the banknote transport cassette 15 can be regarded as short-edge transport. When determining that the orientation can be regarded as short-edge transport, the sheet transport apparatus 4 stores the banknote P in the storage section 26. When the sheet transport apparatus 4 determines that the orientation cannot be regarded as short-edge transport, and performs the first reject transport control, the sheet transport apparatus 4 controls the transport section 5 and the second and the sixth to the ninth diversion mechanisms 522 and 556 to 559 (second diversion section) to temporarily store, in the temporary storage section 30, the banknote P determined not to be regarded as short-edge transport. After the processing on all the banknotes P to be deposited ends, the sheet transport apparatus 4 controls the transport section 5, the second and the sixth to the ninth diversion mechanisms 522 and 556 to 559, and the third diversion mechanism 553 (first diversion section) to store, in the upper reject storage section 28 (first reject storage section), the banknote P temporarily stored in the temporary storage section 30. When the sheet transport apparatus 4 determines that the orientation cannot be regarded as short-edge transport and performs the second reject transport control, the sheet transport apparatus 4 controls the transport section 5 and the second and the fourth to the ninth diversion mechanisms 522 and 554 to 559 to store, in the counting reject storage section 29 (second reject storage section), the banknote P determined not to be regarded as short-edge transport. It is thus possible to store banknotes P in the storage section 26 in a state where the banknotes P have substantially uniform orientations. In particular, when the first reject transport control is performed, all the banknotes P whose orientation cannot be regarded as short-edge transport can be stored in the upper reject storage section 28 in one transport process.

The sheet transport apparatus 4 changes the orientation of the banknote P fed from the storage section 26 in the short-edge transport to the long-edge transport orientation by the orientation changing unit 6, and stores the banknote P in the banknote transport cassette 15 during the withdrawal process to the banknote transport cassette 15. Thus, the sheet transport apparatus 4 can store the banknote P in the banknote transport cassette 15, with the banknote having an appropriate orientation.

The sheet transport apparatus 4 determines whether or not to rotate the banknote P during the withdrawal process to the banknote transport cassette 15. When the first determination method is used, the sheet transport apparatus 4 obtains the interval between two consecutively transported banknotes P based on a detection result in the front detection section 64 or the recognition section 25, and determines not to rotate the two banknotes P when the obtained interval is less than the threshold. When the second determination method is used, the sheet transport apparatus 4 obtains the interval (second interval) between two consecutively transported banknotes P based on the detection result in the front detection section 64 (third or fourth detection section) or the recognition section 25 (third or fourth detection section). Based on the obtained interval and the positions of the two banknotes P in the width direction Dw of the transport path detected by the front detection section 64 or the recognition section 25, the sheet transport apparatus 4 obtains an estimation interval (third interval) estimated on the assumption that the two banknotes P are rotated. When the obtained estimation interval is less than the threshold (third threshold), the sheet transport apparatus 4 determines not to rotate the two banknotes P. When the third determination method is used, the sheet transport apparatus 4 obtains an estimation interval based on the interval between the banknotes P, the positions of the banknotes P in the width direction Dw of the transport path, and the sizes of the banknotes P, which are obtained by detection in the front detection section 64 (third, fourth, or fifth detection section) or the recognition section 25 (third, fourth, or fifth detection section), and determines whether or not to rotate the two banknotes P. The sheet transport apparatus 4 controls the transport section 5 and the third diversion mechanism 553 (first diversion section) to store, in the upper reject storage section 28 (first reject storage section), the two banknotes P determined not to be rotated. It is thus possible to prevent a problem that the transport cannot be performed appropriately, which might occur when two banknotes P the interval between which is less than the threshold are rotated. In particular, when the second determination method is used, determination of whether or not the two banknotes are rotated is made based on the estimation interval estimated on the assumption that two banknotes P are rotated. It is thus possible to appropriately determine a risk of failure to occur in the case where the two banknotes are rotated. Further, when the third determination method is used, the size of the banknote P is also taken into consideration when obtaining the estimation interval, so that the calculation accuracy for the estimation interval can be improved.

Needless to say, the present disclosure is not limited to the embodiment as described hereinabove, and various modifications can be made without departing from the spirit thereof. Any combination of the above-described embodiment and following modifications may be used as long as it is applicable.

Modification 1

Figure 10:
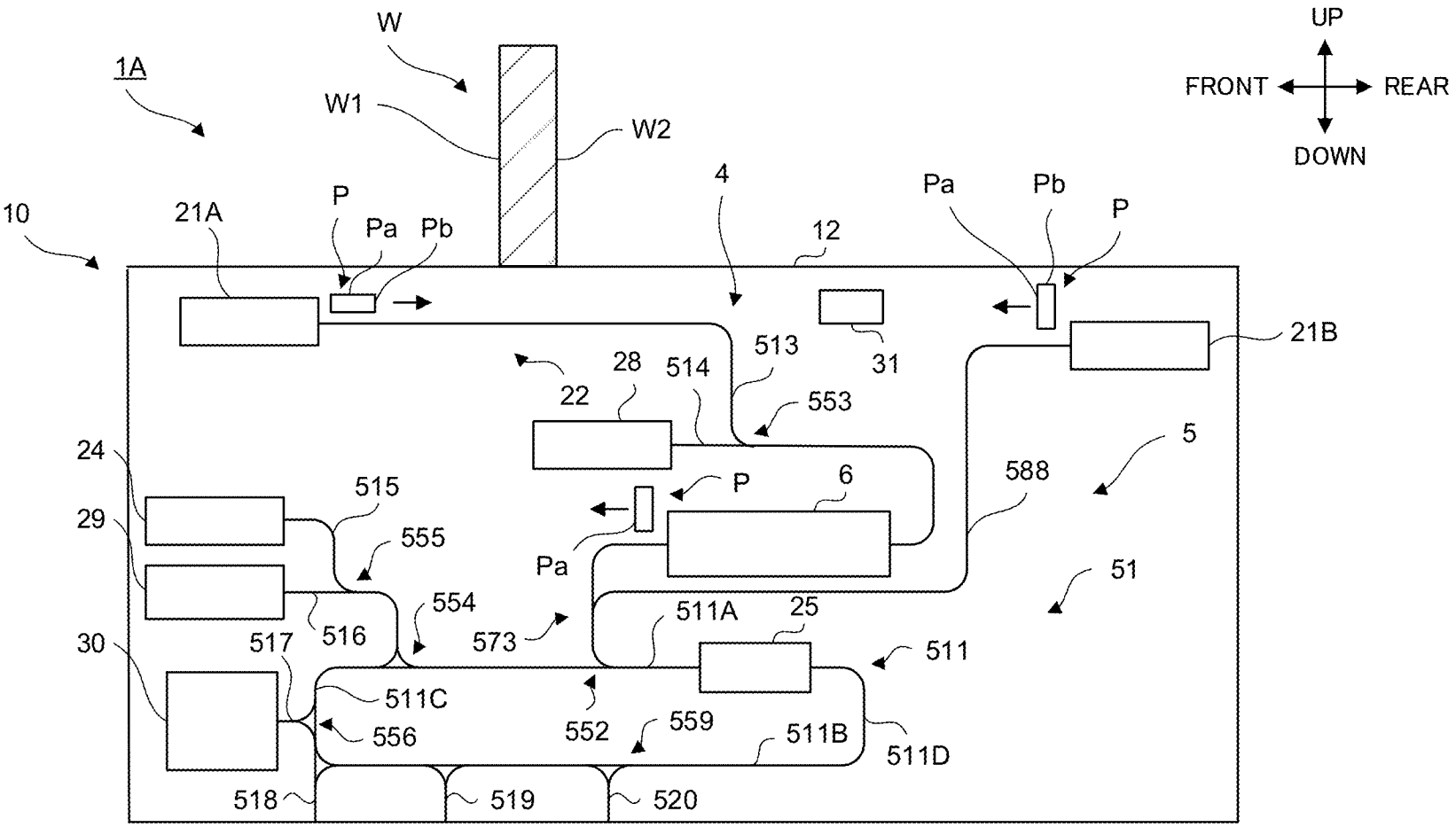
FIG. 10 is a block diagram of principal parts of a sheet processing apparatus according to Modification 1 of the present disclosure.

A sheet processing apparatus 1A according to Modification 1 will be described. FIG. 10 is a block diagram of principal parts of the sheet processing apparatus according to Modification 1. Note that, the same components as those of the sheet processing apparatus 1 of the above embodiment are described in a simplified way or not described. Since the configuration provided in the lower housing 11 is the same between the sheet processing apparatus 1A of Modification 1 and the sheet processing apparatus 1 of the above embodiment, illustration and description thereof are omitted.

As illustrated in FIG. 10, a housing 10 of the sheet processing apparatus 1A of Modification 1 is fitted into a wall body W. For example, a front office of a store, a financial institution, or the like is disposed on the side of a first wall surface W1 of the wall body W. For example, a back office of the store, the financial institution, or the like is disposed on the side of a second wall surface W2 of the wall body W.

A first deposit section 21A (first reception section) for depositing the banknote P is disposed on the side of the first wall surface W1 of the upper housing 12 forming the housing 10. The first deposit section 21A has the same configuration as the deposit section 21 in the above embodiment, except that the first deposit section 21A is configured to be capable of taking in (receiving) banknotes P one by one, with the banknote having the long-edge transport orientation. The first deposit section 21A is connected to the orientation changing unit 6 via the third transport path 513.

A second deposit section 21B (second reception section) for depositing the banknote P is disposed on the side of the second wall surface W2 of the upper housing 12. Like the deposit section 21 of the above embodiment, the second deposit section 21B is configured to be capable of taking in banknotes P one by one, with the banknote having the short-edge transport orientation. The eighteenth transport path 588 connects the third transport path 513 to the second deposit section 21B. A thirteenth diversion mechanism 573 is disposed on the connection portion between the eighteenth transport path 588 and the third transport path 513.

The control section 31 of the sheet processing apparatus 1A rotates, in the orientation changing unit 6, the banknotes P which are deposited from the first deposit section 21A and are long-edge transported, so as to change the orientation of a banknote P to the short-edge transport orientation. The control section 31 stores the banknote P in the first to the sixth storage cassettes 261 to 266, with the banknote having the short-edge transport orientation. The control section 31 of the sheet processing apparatus 1A stores, in the first to the sixth storage cassettes 261 to 266, the banknote P which is deposited from the second deposit section 21B and is short-edge transported, such that the orientation thereof is kept.

According to such a sheet processing apparatus 1A, the banknotes P received by the first deposit section 21A and the second deposit section 21B can be stored in the first to the sixth storage cassettes 261 to 266 while having the short-edge transport orientation.

For example, in the front office, a customer of the store can put the banknote P into the first deposit section 21A, with the banknote having the long-edge transport orientation. Accordingly, the customer can easily put even a banknote P of a smaller size into the first deposit section 21A. For example, in the back office, a manager of the store can put the banknote P into the second deposit section 21B, with the banknote having the short-edge transport orientation. Accordingly, the length of the banknote P in the direction in which the banknote is taken in the second deposit section 21B can be shorter. Consequently, it is possible to shorten time taken for the deposit process.

Modification 2

Figure 11:
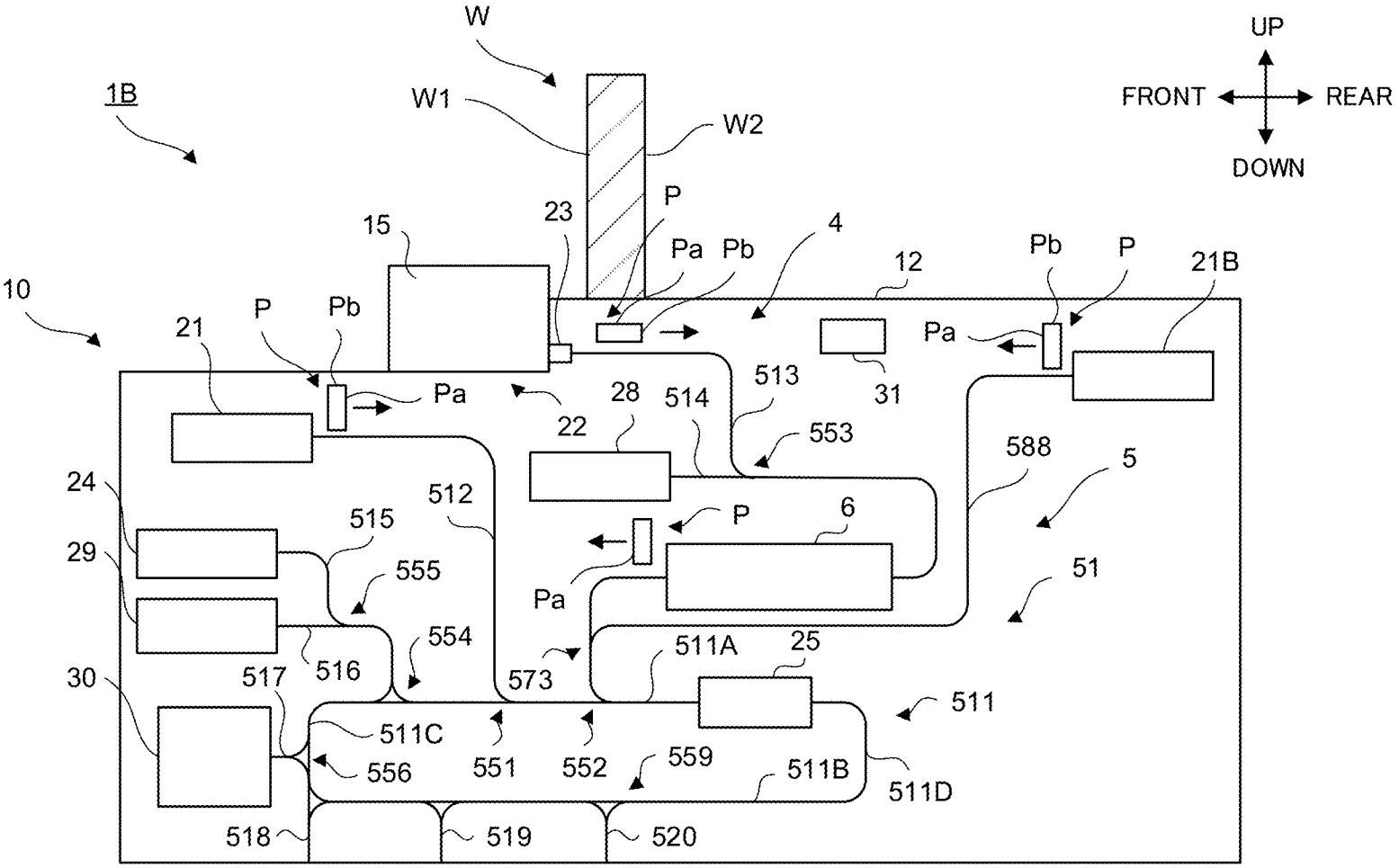
FIG. 11 is a block diagram of principal parts of a sheet processing apparatus according to Modification 2 of the present disclosure.

A sheet processing apparatus 1B according to Modification 2 will be described. FIG. 11 is a block diagram of principal parts of the sheet processing apparatus according to Modification 2. Note that, the same components as those of the sheet processing apparatus 1 of the above embodiment are described in a simplified way or nor described. Since the configuration provided in the lower housing 11 is the same between the sheet processing apparatus 1B of Modification 2 and the sheet processing apparatus 1 of the above embodiment, illustration and description thereof are omitted.

As illustrated in FIG. 11, a housing 10 of the sheet processing apparatus 1B of Modification 2 is fitted into a wall body W, a front office is disposed on the side of the first wall surface W1, and a back office is disposed on the side of the second wall surface W2.

A deposit section 21 (first reception section) for depositing the banknotes P and a deposit/withdrawal section 23 (third reception section) for receiving the banknotes P from the banknote transport cassette 15 are disposed on the side of the first wall surface W1 of the upper housing 12 as in the sheet processing apparatus 1 of the above embodiment. The orientations of the banknotes P deposited from the deposit section 21 and the banknote transport cassette 15 are respectively the same as those in the above embodiment.

A second deposit section 21B (second reception section) for depositing the banknote P is disposed on the side of the second wall surface W2 of the upper housing 12 as in the sheet processing apparatus 1A of Modification 1. The second deposit section 21B is connected to the third transport path 513 via the eighteenth transport path 588 and the thirteenth diversion mechanism 573.

The control section 31 of the sheet processing apparatus 1B stores, in the first to the sixth storage cassettes 261 to 266, the banknotes P which are deposited from the deposit section 21 or the second deposit section 21B and have the short-edge transport orientation while maintaining the orientations thereof. The control section 31 changes, to the short-edge transport orientation, the orientations of the banknotes P deposited from the banknote transport cassette 15 and having the long-edge transport orientation by rotating the banknotes in the orientation changing unit 6. The control section 31 stores the banknotes P in the first to the sixth storage cassettes 261 to 266, with the banknotes having the short-edge transport orientation.

According to such a sheet processing apparatus 1B, the banknotes P received by the deposit section 21, the banknote transport cassette 15, and the second deposit section 21B can be stored in the first to the sixth storage cassettes 261 to 266 while having the short-edge transport orientation. For example, in the back office, a manager of the store can put the banknote P into the second deposit section 21B, with the banknote having the short-edge transport orientation. Thus, the time taken for the deposit process can be shortened.

Other Modifications

The sheet processing apparatuses 1, 1A, and 1B may be provided with only a single configuration through which a banknote P can be inserted into the sheet processing apparatus. In this case, the banknote P may be inserted to be short-edge transported, and stored in the storage section 26 to have the long-edge transport orientation, or may be inserted to be long-edge transported, and stored in the storage section 26 to have the short-edge transport orientation. For example, the sheet processing apparatus 1 may not be provided with the deposit section 21 or the cassette loading section 22.

The banknotes P having the short-edge transport orientation may be rotated to be stored while having the long-edge transport orientation, or the banknotes P stored in the first, the second, the third, the fourth, the fifth, and the sixth storage cassettes 261, 262, 263, 264, 265, and 266 may have orientations different for each of the storage cassettes.

When the banknotes P are rotated by the first and the second direction changing rollers 611 and 612, the set rotational speed of the second direction changing roller 612 may be made faster than the set rotational speed of the first direction changing roller 611 by not changing or by decreasing the set rotational speed of the first direction changing roller 611, the set rotational speeds of both the first and the second direction changing rollers 611 and 612 may be increased such that a rotational speed difference may be caused, or the set rotational speeds of both the first and the second direction changing rollers 611 and 612 may be decreased such that a rotational speed difference may be caused.

The transport direction of the banknote P transported by the second direction changing roller 612 may be parallel to the transport direction of the banknote P transported by the first direction changing roller 611.

The outer peripheral surfaces 614A and 615A of the first and the second contact rollers 614 and 615 may be formed in a flat surface shape in the sections along their respective axes of rotation.

The upper rollers 63 may not be disposed in the orientation changing unit 6.

Although the upper rollers 63 are raised so as not to make contact with the banknote P when the banknote P is rotated, the lower rollers 62 may be lowered so as not to make contact with the banknote P, or the upper rollers 63 may be raised and the lower rollers 62 may be lowered. Although the upper rollers 63 are raised at the same time as the start of rotation of the banknote P, the upper rollers 63 may be raised at a timing earlier than the start of rotation. Although the upper rollers 63 are lowered at the same time as the end of rotation of the banknote P, the upper rollers 63 may be lowered at a timing later than the end of rotation.

The lower rollers 62 may not be provided with the frustoconical portions 622. In FIG. 4, when the banknote P is rotated in the counterclockwise direction in order to change the orientation of the banknote P from the short-edge transport orientation into the long-edge transport orientation, the edge of the banknote P comes into contact with the right (the lower side in FIG. 4) frustoconical portion 622 of one of the lower rollers 62 located on the rear side (the right side in FIG. 4) of the first to the third direction changing rollers 611 to 613, but the edge of the banknote P does not come into contact with the left (the upper side in FIG. 4) frustoconical portion 622. The edge of the banknote P comes into contact with the left frustoconical portion 622 of one of the lower rollers 62 located on the front side (the left side in FIG. 4) of the first to the third direction changing rollers 611 to 613, but the edge of the banknote P does not come into contact with the right frustoconical portion 622. Therefore, the lower roller 62 on the rear side of the first to the third direction changing rollers 611 to 613 may not be provided with the frustoconical portion 622 on the left side and the lower roller 62 on the front side may not be provided with the frustoconical portion 622 on the right side. In a case of a configuration in which the banknote P is rotated in the clockwise direction in order to change the orientation of the banknote P from the short-edge transport orientation into the long-edge transport orientation, the lower roller 62 on the rear side of the first to the third direction changing rollers 611 to 613 may not be provided with the frustoconical portion 622 on the right and the lower roller 62 on the front side may not be provided with the frustoconical portion 622 on the left side.

The third direction changing roller 613 and the third contact roller 616 may not be disposed in the sheet transport apparatus 4.

The rotation angle of the banknote P rotated by the sheet transport apparatus 4 may be fixed or may be set by the operator.

The sheet transport apparatus 4 may rotate all the target banknotes P to be rotated regardless of the interval between each two of the banknotes.

The sheet transport apparatus 4 may rotate the banknote P by the same angle regardless of the orientation of the banknote P before rotation.

The sheet transport apparatus 4 may start rotation of the banknote P at the same timing regardless of the length L of the banknote P before rotation in the direction Dt of the transport path.

The rotation direction of the banknote P in the orientation changing unit 6 may be changed in accordance with the skew state of the banknote P. In this case, the orientation (the skew direction) of the banknote P is detected by a skew detection section (the front detection section 64, the rear detection section 65, or the recognition section 25) located upstream in the transport direction, and the control section 31 determines the rotation direction such that the leading side of the banknote P in the transport direction is first rotated. The control section 31 controls, based on the determination result, the first and the second direction changing rollers 611 and 612 of the orientation changing unit 6 such that the leading side moves in the transport direction when the banknote P is rotated. At this time, the control section 31 controls the first and the second direction changing rollers 611 and 612 such that the banknote P is rotated by applying different rotational speeds between one of the first and the second direction changing rollers 611 and 612 disposed on the leading side of the banknote P and the other direction changing roller.

Even when the control section 31 rotates a banknote P based on the detection results of the front detection section 64, rear detection section 65, or the recognition section 25, there is a possibility that an assembly error or aging degradation in the orientation changing unit 6 may prevent the rotation angle of the banknote P from becoming the desired angle, and accordingly, the predetermined number of banknotes P are not brought into the deposit target state or the withdrawal target state within a predetermined number of transactions or a predetermined period. In such a case, the control section 31 may determine the difference between the actual rotation angle of the banknote P and the desired angle, and change the control contents for the first and the second direction changing rollers 611 and 612 based on the determination result such that the actual rotation angle becomes the desired angle.

The sheet transport apparatus 4 may store the banknote P in the storage section 26 regardless of whether or not the orientation of the rotated banknote P during the deposit process from the banknote transport cassette 15 can be regarded as the short-edge transport.

The sheet transport apparatus 4 may rotate the banknote P only during the deposit process from the banknote transport cassette 15, and may not rotate the banknote P during the withdrawal process from the banknote transport cassette 15. Alternatively, the sheet transport apparatus 4 may rotate the banknote P only during the withdrawal process from the banknote transport cassette 15, and may not rotate the banknote P during the deposit process from the banknote transport cassette 15.

In the sheet processing apparatuses 1 and 1B, it may be possible to load a banknote transport cassette (second cassette) having a shape different from the banknote transport cassette 15 into the cassette loading section 22 via a connecting member, so as to perform the deposit process and the withdrawal process with respect to such a banknote transport cassette. In the sheet processing apparatuses 1, 1A, and 1B, at least one of the banknote transport cassette 15, the deposit section 21, and the first and the second deposit sections 21A and 21B may be configured to be capable of receiving both the banknote P having the long-edge transport orientation and the banknote P having the orientation of short-edge transport orientation. In the sheet processing apparatuses 1, 1A, and 1B, all of the banknote transport cassette 15, the deposit section 21, and the first and the second deposit sections 21A and 21B may be configured to be capable of receiving only the banknote P having the long-edge transport orientation or the short-edge transport orientation.

The interval between the banknotes P, the positions of the banknotes P in the width direction Dw of the transport path, and the sizes of the banknotes P may be detected by respective different detection sections.

The sheet processed by the sheet processing apparatus may be a voucher, a check, securities, card-like medium, and the like.

Figure 12:
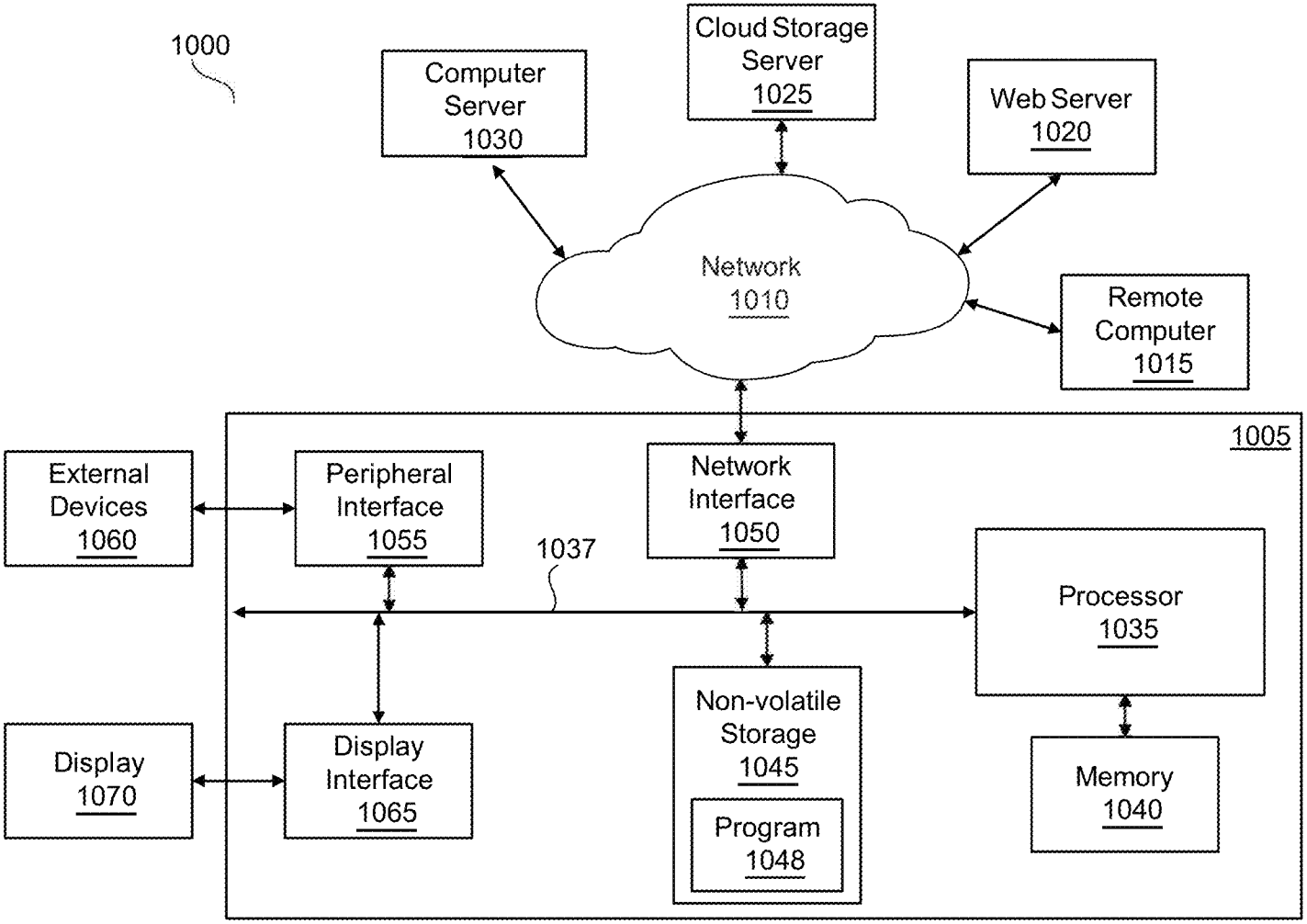
FIG. 12 is a block diagram of computer-based circuitry that may be used to implement control features of the present disclosure.

FIG. 12 illustrates a block diagram of a computer that may implement the various embodiments described herein. The present disclosure may be embodied as a system, a method, and/or a computer program product. The computer program product may include a non-transitory computer readable storage medium on which computer readable program instructions are recorded that may cause one or more processors to carry out aspects of the embodiment. For example, control section 31 and its individual components as well as attached components may be configured to include various elements depicted in FIG. 12.

The non-transitory computer readable storage medium may be a tangible device that can store instructions for use by an instruction execution device (processor). The computer readable storage medium may be, for example, but is not limited to, an electronic storage device, a magnetic storage device, an optical storage device, an electromagnetic storage device, a semiconductor storage device, or any appropriate combination of these devices. A non-exhaustive list of more specific examples of the computer readable storage medium includes each of the following (and appropriate combinations): flexible disk, hard disk, solid-state drive (SSD), random access memory (RAM), read-only memory (ROM), erasable programmable read-only memory (EPROM or Flash), static random access memory (SRAM), compact disc (CD or CD-ROM), digital versatile disk (DVD) and memory card or stick. A computer readable storage medium, as used in this disclosure, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described in this disclosure can be downloaded to an appropriate computing or processing device from a computer readable storage medium or to an external computer or external storage device via a global network (i.e., the Internet), a local area network, a wide area network and/or a wireless network. The network may include copper transmission wires, optical communication fibers, wireless transmission, routers, firewalls, switches, gateway computers and/or edge servers. A network adapter card or network interface in each computing or processing device may receive computer readable program instructions from the network and forward the computer readable program instructions for storage in a computer readable storage medium within the computing or processing device.

Computer readable program instructions for carrying out operations of the present disclosure may include machine language instructions and/or microcode, which may be compiled or interpreted from source code written in any combination of one or more programming languages, including assembly language, Basic, Fortran, Java, Python, R, C, C++, C# or similar programming languages. The computer readable program instructions may execute entirely on a user's personal computer, notebook computer, tablet, or smartphone, entirely on a remote computer or compute server, or any combination of these computing devices. The remote computer or compute server may be connected to the user's device or devices through a computer network, including a local area network or a wide area network, or a global network (i.e., the Internet). In some embodiments, electronic circuitry including, for example, programmable logic circuitry, field-programmable gate arrays (FPGA), or programmable logic arrays (PLA) may execute the computer readable program instructions by using information from the computer readable program instructions to configure or customize the electronic circuitry, in order to perform aspects of the present disclosure.

Aspects of the present disclosure are described herein with reference to flow diagrams and block diagrams of methods, apparatus (systems), and computer program products according to embodiments of the disclosure. It will be understood by those skilled in the art that each block of the flow diagrams and block diagrams, and combinations of blocks in the flow diagrams and block diagrams, can be implemented by computer readable program instructions.

The computer readable program instructions that may implement the systems and methods described in this disclosure may be provided to one or more processors (and/or one or more cores within a processor) of a general purpose computer, special purpose computer, or other programmable apparatus to produce a machine, such that the instructions, which execute via the processor of the computer or other programmable apparatus, create a system for implementing the functions specified in the flow diagrams and block diagrams in the present disclosure. These computer readable program instructions may also be stored in a computer readable storage medium that can direct a computer, a programmable apparatus, and/or other devices to function in a particular manner, such that the computer readable storage medium having stored instructions is an article of manufacture including instructions which implement aspects of the functions specified in the flow diagrams and block diagrams in the present disclosure.

The computer readable program instructions may also be loaded onto a computer, other programmable apparatus, or other device to cause a series of operational steps to be performed on the computer, other programmable apparatus or other device to produce a computer implemented process, such that the instructions which execute on the computer, other programmable apparatus, or other device implement the functions specified in the flow diagrams and block diagrams in the present disclosure.

FIG. 12 is a functional block diagram illustrating a networked system 1000 of one or more networked computers and servers. In an embodiment, the hardware and software environment illustrated in FIG. 12 may provide an exemplary platform for implementation of the software and/or methods according to the present disclosure.

Referring to FIG. 12, a networked system 1000 may include, but is not limited to, computer 1005, network 1010, remote computer 1015, web server 1020, cloud storage server 1025 and compute server 1030. In some embodiments, multiple instances of one or more of the functional blocks illustrated in FIG. 12 may be employed.

Additional detail of computer 1005 is shown in FIG. 12. The functional blocks illustrated within computer 1005 are provided only to establish exemplary functionality and are not intended to be exhaustive. And while details are not provided for remote computer 1015, web server 1020, cloud storage server 1025 and compute server 1030, these other computers and devices may include similar functionality to that shown for computer 1005.

Computer 1005 may be a personal computer (PC), a desktop computer, laptop computer, tablet computer, netbook computer, a personal digital assistant (PDA), a smart phone, or any other programmable electronic device capable of communicating with other devices on network 1010.

Computer 1005 may include processor 1035, bus 1037, memory 1040, non-volatile storage 1045, network interface 1050, peripheral interface 1055 and display interface 1065. Each of these functions may be implemented, in some embodiments, as individual electronic subsystems (integrated circuit chip or combination of chips and associated devices), or, in other embodiments, some combination of functions may be implemented on a single chip (sometimes called a system on chip or SoC).

Processor 1035 may be one or more single or multi-chip microprocessors, such as those designed and/or manufactured by Intel Corporation, Advanced Micro Devices, Inc. (AMD), Arm Holdings (Arm), Apple Computer, etc. Examples of microprocessors include Celeron, Pentium, Core i3, Core i5 and Core i7 from Intel Corporation; Opteron, Phenom, Athlon, Turion and Ryzen from AMD; and Cortex-A, Cortex-R and Cortex-M from Arm.

Bus 1037 may be a proprietary or industry standard high-speed parallel or serial peripheral interconnect bus, such as ISA, PCI, PCI Express (PCI-e), AGP, and the like.

Memory 1040 and non-volatile storage 1045 may be computer-readable storage media. Memory 1040 may include any suitable volatile storage devices such as Dynamic Random Access Memory (DRAM) and Static Random Access Memory (SRAM). Non-volatile storage 1045 may include one or more of the following: flexible disk, hard disk, solid-state drive (SSD), read-only memory (ROM), erasable programmable read-only memory (EPROM or Flash), compact disc (CD or CD-ROM), digital versatile disk (DVD) and memory card or stick.

Program 1048 may be a collection of machine readable instructions and/or data that is stored in non-volatile storage 1045 and is used to create, manage and control certain software functions that are discussed in detail elsewhere in the present disclosure and illustrated in the drawings. In some embodiments, memory 1040 may be considerably faster than non-volatile storage 1045. In such embodiments, program 1048 may be transferred from non-volatile storage 1045 to memory 1040 prior to execution by processor 1035.

Computer 1005 may be capable of communicating and interacting with other computers via network 1010 through network interface 1050. Network 1010 may be, for example, a local area network (LAN), a wide area network (WAN) such as the Internet, or a combination of the two, and may include wired, wireless, or fiber optic connections. In general, network 1010 can be any combination of connections and protocols that support communications between two or more computers and related devices.

Peripheral interface 1055 may allow for input and output of data with other devices that may be connected locally with computer 1005. For example, peripheral interface 1055 may provide a connection to external devices 1060. External devices 1060 may include devices such as a keyboard, a mouse, a keypad, a touch screen, and/or other suitable input devices. External devices 1060 may also include portable computer-readable storage media such as, for example, thumb drives, portable optical or magnetic disks, and memory cards. Software and data used to practice embodiments of the present disclosure, for example, program 1048, may be stored on such portable computer-readable storage media. In such embodiments, software may be loaded onto non-volatile storage 1045 or, alternatively, directly into memory 1040 via peripheral interface 1055. Peripheral interface 1055 may use an industry standard connection, such as RS-232 or Universal Serial Bus (USB), to connect with external devices 1060.

Display interface 1065 may connect computer 1005 to display 1070. Display 1070 may be used, in some embodiments, to present a command line or graphical user interface to a user of computer 1005. Display interface 1065 may connect to display 1070 using one or more proprietary or industry standard connections, such as VGA, DVI, DisplayPort and HDMI.

As described above, network interface 1050, provides for communications with other computing and storage systems or devices external to computer 1005. Software programs and data discussed herein may be downloaded from, for example, remote computer 1015, web server 1020, cloud storage server 1025 and compute server 1030 to non-volatile storage 1045 through network interface 1050 and network 1010. Furthermore, the systems and methods described in this disclosure may be executed by one or more computers connected to computer 1005 through network interface 1050 and network 1010. For example, in some embodiments the systems and methods described in this disclosure may be executed by remote computer 1015, computer server 1030, or a combination of the interconnected computers on network 1010.

Data, datasets and/or databases employed in embodiments of the systems and methods described in this disclosure may be stored and or downloaded from remote computer 1015, web server 1020, cloud storage server 1025 and compute server 1030.

REFERENCE SIGNS LIST

1, 1A, 1B Sheet processing apparatus
4 Sheet transport apparatus
5 Transport section
6 Orientation changing unit
10 Housing
11 Lower housing
12 Upper housing
15 Banknote transport cassette
21 Deposit section
21A First deposit section
21B Second deposit section
22 Cassette loading section
23 Deposit/withdrawal section
24 Withdrawal section
25 Recognition section
26 Storage section
27 Collection section
28 Upper reject storage section
29 Counting reject storage section
30 Temporary storage section
31 Control section
51 Upper transport section
53 Lower transport section
61 Orientation changing section
62 Lower roller
63 Upper roller
64 Front detection section
65 Rear detection section
66 Front tracking sensor
67 Rear tracking sensor
261, 262, 263, 264, 265, 266 First, second, third, fourth, fifth, and sixth storage cassettes
511, 512, 513, 514, 515, 516, 517, 518, 519, 520, 531, 532, 533, 534, 535, 536, 537, 588 First, second, third, fourth, fifth, sixth, seventh, eighth, ninth, tenth, eleventh, twelfth, thirteenth, fourteenth, fifteenth, sixteenth, seventeenth, and eighteenth transport paths
511A Upper path
511B Lower path
511C Front inversion path
511D Rear inversion path
513A Left side wall
513B Right side wall
551, 552, 553, 554, 555, 556, 557, 558, 559, 560, 561, 562, 573 First, second, third, fourth, fifth, sixth, seventh, eighth, ninth, tenth, eleventh, twelfth, and thirteenth diversion mechanisms
611, 612, 613 First, second, and third direction changing rollers
611A, 612A, 613A Outer peripheral surface
614, 615, 616 First, second, and third contact rollers
614A, 615A, 616A Outer peripheral surface
621 Straight barrel portion
622 Frustoconical portion
622A Inclined surface
622B Upper end
641 Line sensor
651 Line sensor
661 Sensor
671 Sensor
P Banknote
Pa long side
Pb short side
R Rotation track

The invention claimed is:

1. A sheet transport apparatus, comprising:

a transport path to transport a sheet along the transport path in a transport direction and is provided with rollers including a first direction changing roller and a second direction changing roller, wherein the first direction changing roller and the second direction changing roller are arranged in a width direction perpendicular to the transport direction of the transport path; and a controller configured to control at least one of the rollers to change an orientation of the sheet from a first orientation to a second orientation, wherein the orientation of the sheet is changed when the controller controls the at least one of the rollers such that the first direction changing roller rotates slower than the second direction changing roller, the first direction changing roller is disposed to transport the sheet in a first direction which is the transport direction along the transport path, the second direction changing roller is disposed to transport the sheet in a second direction diverging away from the first direction changing roller downstream along the transport path, and the orientation of the sheet is changed when:

the controller controls the first direction changing roller to rotate at a first new rotational speed that is different from a first rotational speed before and after the orientation of the sheet is changed, and does not adjust a second rotational speed of the second direction changing roller, or the controller controls the second direction changing roller to rotate at a second new rotational speed that is different from the second rotational speed before and after the orientation of the sheet is changed, and does not adjust the first rotational speed of the first direction changing roller.

2. The sheet transport apparatus according to claim 1, wherein an angle formed between the first direction and the second direction is 5±2°.

3. The sheet transport apparatus according to claim 1, further comprising:

a first contact roller that, together with the first direction changing roller, contacts the sheet; and a second contact roller that, together with the second direction changing roller, contacts the sheet, wherein an outer peripheral surface of each of the first contact roller and the second contact roller in a section along an axis of rotation of the first contact roller and the second contact roller has a curved surface shape.

4. The sheet transport apparatus according to claim 1, wherein the controller controls the first direction changing roller and the second direction changing roller to rotate the sheet by 90±20°.

5. The sheet transport apparatus according to claim 1, further comprising:

a detection sensor disposed on an upstream side of the transport path with respect to the first direction changing roller and the second direction changing roller along the transport path, the detection sensor configured to detect a length of the sheet in the transport direction of the transport path, wherein the controller is configured to adjust, based on a result of detection by the detection sensor, a timing of a start of adjustments to a rotation speed of one of the first direction changing roller and the second direction changing roller such that a start position of rotation of the sheet is located at a predetermined position in the width direction of the transport path.

6. The sheet transport apparatus according to claim 5, wherein the controller is configured to adjust the timing such that the start position of the rotation of the sheet is located in a middle of the transport path in the width direction.

7. The sheet transport apparatus according to claim 1, wherein the controller is further configured to determine whether the orientation of the sheet is to be changed.

8. The sheet transport apparatus according to claim 7, wherein in a case that the controller determines that the orientation of the sheet is to be changed, the controller controls the at least one of the rollers such that the first direction changing roller rotates slower than the second direction changing roller.

9. The sheet transport apparatus according to claim 1, wherein the controller is further configured to determine whether the orientation of the sheet is to be changed, based on an interval between two consecutively transported sheets.

10. The sheet transport apparatus according to claim 9, wherein in a case that the interval is less than a threshold, the orientation of the sheet is not changed.

11. A sheet processing apparatus, comprising:

a storage section configured to store one or more sheets; and the sheet transport apparatus according to claim 1.

12. The sheet processing apparatus according to claim 11, further comprising:

a first transport mechanism configured to transport a sheet received from a first reception section to the storage section without the orientation of the sheet changed; and a second transport mechanism configured to transport a sheet received from a second reception section to the storage section via the sheet transport apparatus with the orientation of the sheet changed.

13. The sheet processing apparatus according to claim 11, wherein depending on a transport destination, the orientation of the sheet is changed when the sheet is to be stored in the storage section and the orientation of the sheet is not changed when the sheet is to be rejected.

14. The sheet processing apparatus according to claim 11, wherein in a case that a rotated sheet is not in a predetermined target state, the rotated sheet is to be rejected.

15. A sheet transport apparatus, comprising:

a transport path to transport a sheet along the transport path in a transport direction and is provided with rollers including a first direction changing roller and a second direction changing roller, wherein the first direction changing roller and the second direction changing roller are arranged in a width direction perpendicular to the transport direction of the transport path;

a controller configured to control at least one of the rollers to change an orientation of the sheet from a first orientation to a second orientation;

a lower roller disposed within a rotation track of the sheet; and an upper roller disposed above the lower roller, wherein the orientation of the sheet is changed when the controller controls the at least one of the rollers such that the first direction changing roller rotates slower than the second direction changing roller, the first direction changing roller is disposed to transport the sheet in a first direction which is the transport direction along the transport path, the second direction changing roller is disposed to transport the sheet in a second direction diverging away from the first direction changing roller downstream along the transport path, the orientation of the sheet is not changed when the controller controls the lower roller and the upper roller such that the lower roller and the upper roller are in contact with the sheet, and the orientation of the sheet is changed when the controller controls one of the lower roller and the upper roller to be in contact with the sheet and controls another of the lower roller and the upper roller to be not in contact with the sheet.

16. A sheet transport apparatus, comprising:

a transport path to transport a sheet along the transport path in a transport direction and is provided with rollers including a first direction changing roller and a second direction changing roller, wherein the first direction changing roller and the second direction changing roller are arranged in a width direction perpendicular to the transport direction of the transport path;

a controller configured to control at least one of the rollers to change an orientation of the sheet from a first orientation to a second orientation; and a detection sensor configured to detect the orientation of the sheet at an upstream side of the transport path with respect to the first direction changing roller and the second direction changing roller along the transport path, wherein the orientation of the sheet is changed when the controller controls the at least one of the rollers such that the first direction changing roller rotates slower than the second direction changing roller, the first direction changing roller is disposed to transport the sheet in a first direction which is the transport direction along the transport path, the second direction changing roller is disposed to transport the sheet in a second direction diverging away from the first direction changing roller downstream along the transport path, and the controller is further configured to control the first direction changing roller and the second direction changing roller to rotate, based on a detection result of detection by the detection sensor, the sheet such that the transport direction of the transport path and a long side edge or a short side edge of the sheet are parallel to each other.

* * * * *